US006113127A

United States Patent [19]

Karol

[11] Patent Number: 6,113,127

[45] Date of Patent: Sep. 5, 2000

[54] SNOWBOARD BINDING SYSTEM

[76] Inventor: Chris Karol, P.O. Box 6144, Vail, Colo. 81658

[21] Appl. No.: 08/737,627

[22] PCT Filed: May 20, 1996

[86] PCT No.: PCT/US96/07348

§ 371 Date: Apr. 25, 1997

§ 102(e) Date: Apr. 25, 1997

[87] PCT Pub. No.: WO97/03734

PCT Pub. Date: Feb. 6, 1997

Related U.S. Application Data

[63] Continuation-in-part of application No. 08/505,578, Jul. 21, 1995, Pat. No. 5,690,351.

[51] Int. Cl.[7] ..... A63C 9/08

[52] U.S. Cl. ..... 280/618; 280/624; 280/634; 280/14.2

[58] Field of Search ..... 280/607, 613, 280/617, 618, 624, 625, 636, 14.2, 634

[56] References Cited

U.S. PATENT DOCUMENTS

| | | | |
|---|---|---|---|
| Re. 33,544 | 2/1991 | Dennis | 280/618 |
| 3,271,040 | 9/1966 | Spademan | 280/11.35 |
| 3,606,370 | 9/1971 | Spademan | 280/11.35 |

(List continued on next page.)

FOREIGN PATENT DOCUMENTS

| | | |
|---|---|---|
| 0 105 011 | 9/1982 | European Pat. Off. . |
| 2 643 277 | 2/1989 | France . |

OTHER PUBLICATIONS

Transworld SNOWboarding Business, vol. 6, No. 5, Mar., 1995.

*Primary Examiner*—Michael Mar
*Attorney, Agent, or Firm*—Sheridan Ross P.C.

[57] ABSTRACT

A snowboard binding system comprising at least one movable engaging member that, when engaged, secures a snowboarder's boot from vertical or horizontal movement. In one embodiment, the binding system has two active sides, allowing a snowboarder to engage the binding by stepping downwardly onto the binding mechanism, thus reversibly forcing tensioned engaging members between an extended and a retracted position and back to an extended position, thereby securing the snowboarder's boot to the upper surface of a snowboard. A preferred embodiment utilizes positioning keys that properly orientate a snowboarder's boot into binding engagement. Other embodiments include snowboard boots having active binding mechanisms positioned on the boot itself, such mechanisms engageable with static members secured to the surface of a snowboard. One snowboard boot has a calf support member and a reversibly mounted high-back element, as well as a canting system for adjusting angular orientation of a snowboarder's foot position.

24 Claims, 29 Drawing Sheets

U.S. PATENT DOCUMENTS

| | | | |
|---|---|---|---|
| 3,771,806 | 11/1973 | Hinterholzer et al. | 280/11.35 |
| 3,779,570 | 12/1973 | Betschart, Jr. | 280/11.35 |
| 3,785,668 | 1/1974 | Marker | 280/11.35 |
| 3,838,866 | 10/1974 | D'Alessio et al. | 280/11.35 |
| 3,900,204 | 8/1975 | Weber | 280/11.13 |
| 3,905,613 | 9/1975 | Romeo | 280/11.35 |
| 3,936,062 | 2/1976 | Schweizer | 280/11.35 |
| 3,944,240 | 3/1976 | Bodendorfer | 280/624 X |
| 4,036,510 | 7/1977 | D'Alessio et al. | 280/613 |
| 4,042,257 | 8/1977 | Salomon | 280/624 |
| 4,160,556 | 7/1979 | Gertsch | 280/11.13 |
| 4,177,584 | 12/1979 | Beyl | 280/613 X |
| 4,182,525 | 1/1980 | Spademan | 280/624 |
| 4,352,508 | 10/1982 | Spademan | 280/624 |
| 4,353,574 | 10/1982 | Faulin | 280/613 |
| 4,415,176 | 11/1983 | Hull et al. | 280/624 X |
| 4,741,550 | 5/1988 | Dennis | 280/618 |
| 4,856,808 | 8/1989 | Longoni | 280/617 |
| 4,973,073 | 11/1990 | Raines et al. | 280/624 |
| 4,979,760 | 12/1990 | Derrah | 280/607 |
| 5,028,068 | 7/1991 | Donovan | 280/618 |
| 5,035,443 | 7/1991 | Kincheloe | 280/618 |
| 5,044,656 | 9/1991 | Peyre | 280/618 |
| 5,054,807 | 10/1991 | Fauvet | 280/607 |
| 5,069,463 | 12/1991 | Baud et al. | 280/14.2 |
| 5,085,455 | 2/1992 | Bogner et al. | 280/618 |
| 5,094,470 | 3/1992 | Riedel | 280/607 |
| 5,143,396 | 9/1992 | Shaanan et al. | 280/607 |
| 5,188,386 | 2/1993 | Schweizer | 280/607 |
| 5,299,823 | 4/1994 | Glaser | 280/625 |
| 5,333,892 | 8/1994 | Stritzl et al. | 280/634 X |
| 5,344,179 | 9/1994 | Fritschi et al. | 280/618 |
| 5,354,088 | 10/1994 | Vetter et al. | 280/618 |
| 5,356,170 | 10/1994 | Carpenter et al. | 280/618 |
| 5,401,041 | 3/1995 | Jespersen | 280/14.2 |
| 5,474,322 | 12/1995 | Perkins et al. | 280/613 |
| 5,505,477 | 4/1996 | Turner et al. | 280/613 |
| 5,520,406 | 5/1996 | Anderson et al. | 280/633 X |
| 5,558,355 | 9/1996 | Henry | 280/624 |
| 5,577,757 | 11/1996 | Riepl et al. | 280/624 |
| 5,755,046 | 5/1998 | Dodge | 280/613 X |
| 5,871,226 | 2/1999 | Klubitschko et al. | 280/624 |

SNOWBOARD BINDING SYSTEM

This application is a cip of Ser. No. 08/505,578 filed Jul. 21, 1995, now U.S. Pat. No. 5,690,351.

FIELD OF THE INVENTION

The present invention is directed to a snowboard binding system, and more particularly to a side engaging binding having at least one movable engaging member that secures a snowboarder's boot from moving in a vertical or horizontal position once engaged.

BACKGROUND OF THE INVENTION

With the ever increasing popularity of the sport of snowboarding, a need exists for a user-friendly binding system that enables a novice snowboarder to readily adopt the sport without having extensive knowledge of boots and bindings and how they interrelate. An effective binding system must enable a snowboarder to quickly and easily engage and disengage his/her boot from a snowboard. A release mechanism is required that is convenient to operate so that a snowboarder can disengage his/her boot while mounting a chair lift or, in the event of a fall, release as necessary on a snowboard run, such as where the snowboarder requires release from the snowboard in deep snow. A snowboard binding system should be relatively lightweight, sturdy, adaptable to different size boots, rugged, capable of working under conditions where snow and ice may accumulate and must be operable by individuals with gloved hands.

Numerous patents have issued disclosing various types of snowboard bindings, such bindings capable of being categorized as being either toe-to-heel bindings, underfoot attachment bindings or side mounted bindings. Existing designs for toe-to-heel bindings fail to provide the side-to-side support desired by snowboarders, especially given the preferred positioning of a snowboarder's feet along a transverse angle from the longitudinal axis of the snowboard. The "board feel" experienced by snowboarders using a side mounted binding is believed to be superior to that experienced using a toe-to-heel binding. By gripping a snowboarder's boot along the lateral edges of a boot sole, rather than from the toe and heel of a boot, a reduction in the mechanical stresses on the snowboarder's anatomy is achieved since the lateral edges of a snowboarder's boot receive a greater amount of mechanical stress than those encountered at the toe and heel.

Several patents have issued relating to side boot-mounted bindings. For example, U.S. Pat. No. 5,035,443 to Kincheloe discloses a binding in which a boot slides into engagement with a socket member that engages a boot plate underneath the boot sole. The necessity of slidably engaging a boot to a binding, however, presents difficulties in situations where a snowboarder is unable to readily move his/her boot in a manner allowing the boot to slide out of engagement.

U.S. Pat. No. 4,973,073 to Raines et al. describes a binding that relies upon a spring-loaded, cam operated latch on one side of a snowboard binding to secure a boot to a snowboard. Specially designed ridges on each side of a boot are gripped by a pair of opposed mating sockets on the surface of the snowboard, one of such sockets having a spring biased hooking lip rotatably mounted via downwardly projecting portions. The rotational motion of the hooking lip latches one of the ridge portions of the boot binding. A snowboarder is required to first insert a first binding ridge into a longitudinal socket defined by a first ridge entrapping member, and once seated in the socket, the snowboard rider angularly lowers the other side of the boot to allow a second binding ridge to slip downward past the rotating hooking lip. Raines et al.'s design thus requires the angular positioning of a snowboarder's boot to engage the binding and relies upon the rotational interaction of a boot ridge with a pivoting hooking lip.

U.S. Pat. No. 5,299,823 to Glaser describes the use of a boot plate engageable by a fixed jaw and an opposite slide jaw assembly. The slide jaw assembly engages edge portions of a boot plate and has three operating modes, adjusted by moving a cammed lever into either an engaging, locking or intermediate position. A rider first engages the fixed jaw side of the binding and then, with the cammed lever in a proper position, angularly engages the slide jaw so as to cause rotation about a center axis of a locking arm. A rotational force is exerted on the locking arm until a final locking position is achieved whereby the slide jaw housing snaps back to a position to engage the boot plate.

U.S. Pat. No. 4,352,508 to Spademan discloses a ski binding in which opposing pivotally mounted lever members are operated by depressing a heel-receiving member with the tip of a ski pole. By stepping into the bindings, the heel member opens a levered clamping mechanism until the ski boot is placed in the skiing position, at which time the clamping members are allowed to move to a closed position under a biased action of the levered clamping members.

Despite these prior designs, however, a need still exists for a relatively inexpensive, rugged and simple binding system that affords the user-friendliness demanded by novice snowboarders, as well as the ease of operation and superlative board-feel desired by experienced snowboarders. There is also a need for a boot that cooperates with a binding system in such a manner as to facilitate the increasingly demanding safety and performance characteristics desired by today's snowboarders.

Conventional snowboard boots have been generally of a soft shell design and snowboarders often utilize insulated boots such as Sorels™. The mechanical stresses encountered by a snowboarder in manipulating a snowboard, however, require certain aspects of a boot to be more rigid to provide support of various desired ankle and leg configurations. There is, therefore, a need for a snowboarding boot that is designed to cooperate with a side-mounted binding in such a way as to afford a snowboarder maximum support for safety reasons, as well as to enhance desired board-feel.

SUMMARY OF THE INVENTION

The present invention is directed to a snowboard binding system that comprises a side engaging boot binding having at least one active side that permits easy step-in engagement by a snowboarder and that facilitates securement of a snowboarder's boot without undesired vertical and horizontal movements. The present invention provides a system whereby vertical pressure by a snowboarder's boot toward the surface of the snowboard moves an engaging member from a first extended position to a second retracted position, and finally back to the first extended position, thereby securing the boot to the boot binding. A lever is operably attached to the engaging member and is movable between first and second positions which moves the engaging member between extended and retracted positions, thereby providing for easy disengagement of a boot from the binding. The engaging member of the present invention is reversibly movable in a substantially horizontal direction away from and toward a rider's boot and the tensional force exerted by the engaging member is preferably adjustable.

In one embodiment, the engaging member is received in a receptacle formed in the lateral side of the sole of a boot, such receptacle either being formed as an integral part of the sole or formed in a boot plate that is attachable to a sole. The engaging mechanism of the present invention provides for the securing of a rider's boot so that neither horizontal nor vertical movement of the boot is possible after engagement. Preferably the restriction of both vertical and horizontal movement are achieved by the movable engaging member, however, static elements can be used to prevent horizontal movement while the engaging member can be solely relied upon to restrict vertical movement of a boot from a snowboard's surface.

The engaging member of the present invention can be formed from one solid piece of material, or can be of a toothed design. The engaging member's housing can be of an open construction to permit the evacuation of undesired snow or ice from the path of the engaging member. More than one tensioned engaging member can be utilized on one side of a boot to facilitate different torsional control of a binding along the lateral length of a rider's boot.

In one particular embodiment of the present invention, two engaging members are utilized on each opposing side of a rider's boot, thereby alleviating any need for angular positioning of a rider's boot into a fixed binding mount.

Another embodiment of the present invention involves a duo-active sided binding system whereby both engaging members are operable by adjusting a single lever positioned on one or the other side of the binding.

A separate aspect of the present invention is directed to a boot designed to operate effectively with a side engaging and/or duo-active side engaging binding system. A calf support member is operatively attached to a vertically adjustable high-back element. The calf support member is designed so as to permit lateral movement of a snowboarder's leg, thereby permitting slidable lateral movement while still maintaining desired support characteristics of the boot. The high-back element is reversibly engageable with a nub on the boot itself, thus allowing the detachment of the high-back element to afford a natural walking motion by a snowboarder when not engaged in snowboarding.

In one embodiment of the present invention, positioning keys and positioning contours (guidance ramps and complementary structures) are provided on the binding system so that a snowboarder's boot is guided into operative proper engagement. The positioning keys naturally guide the snowboarder's in the proper position with the binding system and also act as an impediment to horizontal movement of a snowboarder's boot.

The engaging members of the present invention can be either active or static and can be located on a boot sole or, alternatively, as part of the binding system itself. Preferably, the engaging member is of a 3.5" length to hold the boot in a stable position when engaged with the binding system, preferably a length that extends between about 10% to about 100% of the length of a snowboarder's boot, and preferably at least about 15% of a snowboarder's boot. The engaging member can be of any suitable depth or width, but is preferably at least about ¼ inch so as to facilitate proper engagement with a corresponding receptacle or lateral engaging ledge.

In one embodiment, engaging members can be locked into an open position, whereby engaging members are maintained in a retracted state, thus facilitating chair lift boarding and propulsion using a free foot by a snowboarder.

In yet another embodiment to the present invention, engaging members are connected to springs located substantially underneath a snowboarder's foot, thus reducing the amount of hardware on the surface of the snowboard surrounding a snowboarder's engaged boot.

Yet another embodiment of the present invention includes warming means to facilitate the melting of ice or snow on the binding system, and additionally warms the feet of a snowboarder.

Other aspects and embodiments of the present invention can be further understood by referring to the drawings below as well as to the detailed description of preferred embodiments of the present invention.

DETAILED DESCRIPTION OF THE PREFERRED EMBODIMENT

Figure 1:
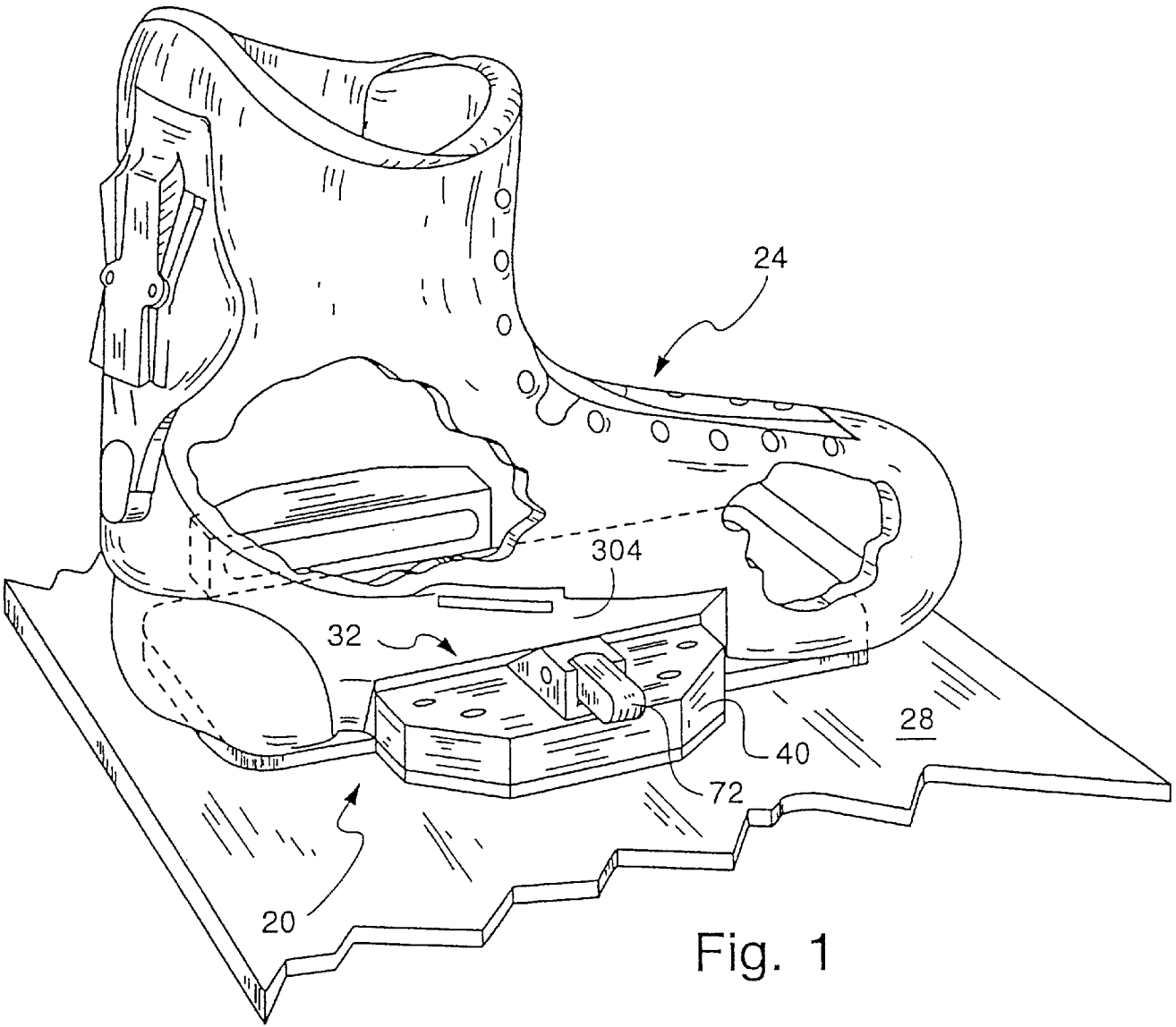
FIG. 1 shows the binding system 20 of the present invention with a boot 24 in an engaged position.
Figure 2:
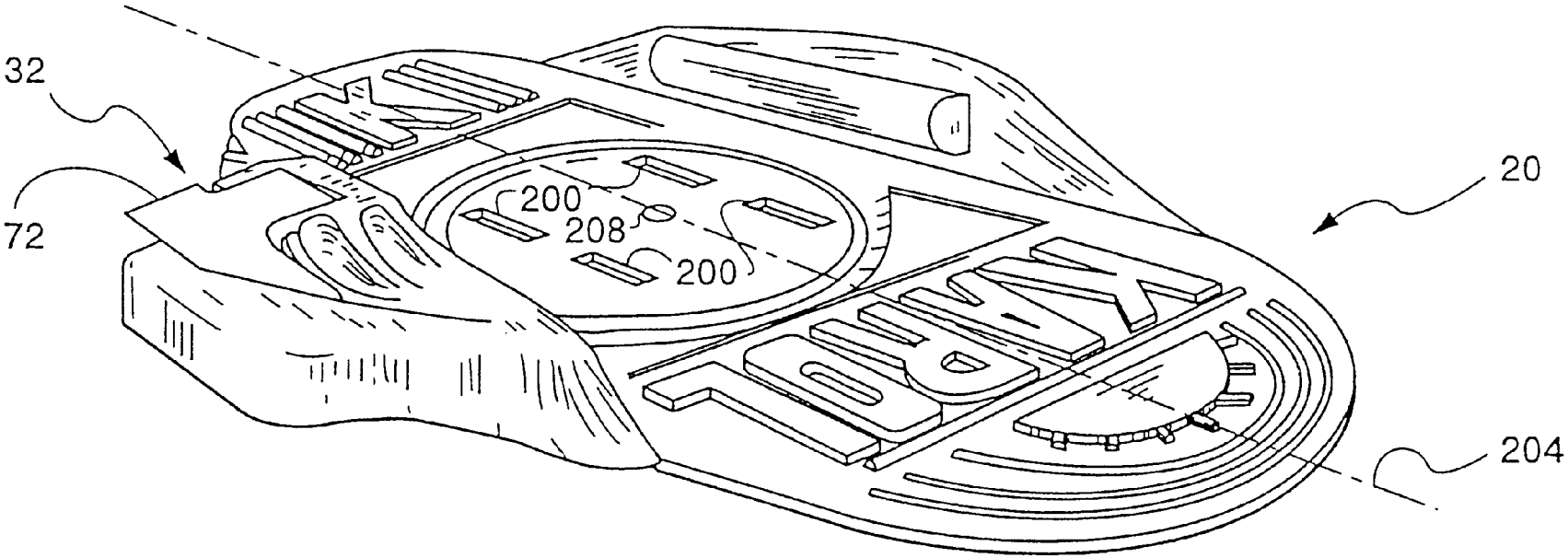
FIG. 2 is a perspective view of a molded embodiment of the present invention showing, for instance, the securing slots 200 where the binding system 20 attaches to a snowboard.
Figure 3A:
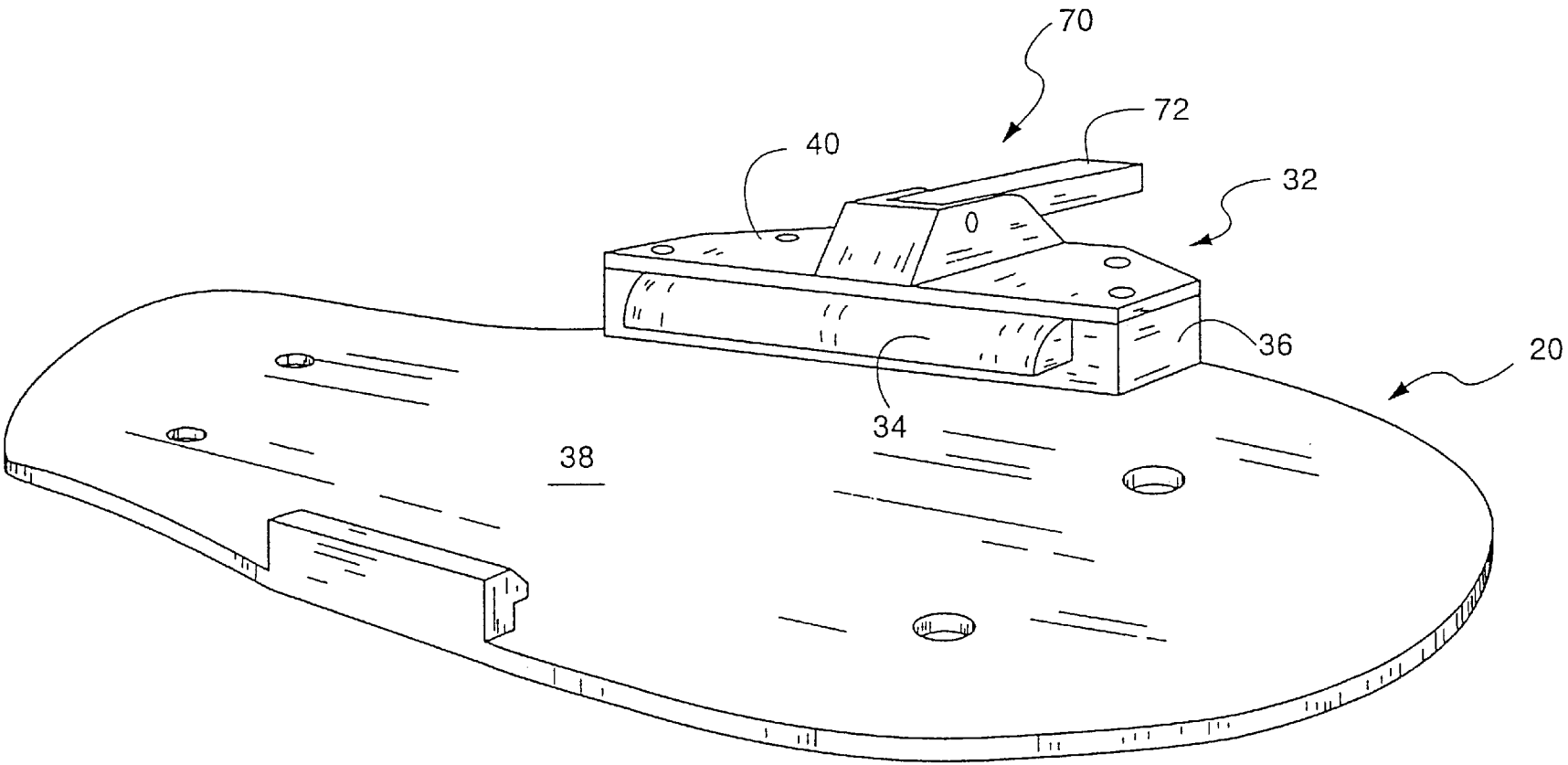
FIG. 3A is another perspective view of the binding system 20 having one active side engaging mechanism 32.
Figure 3B:
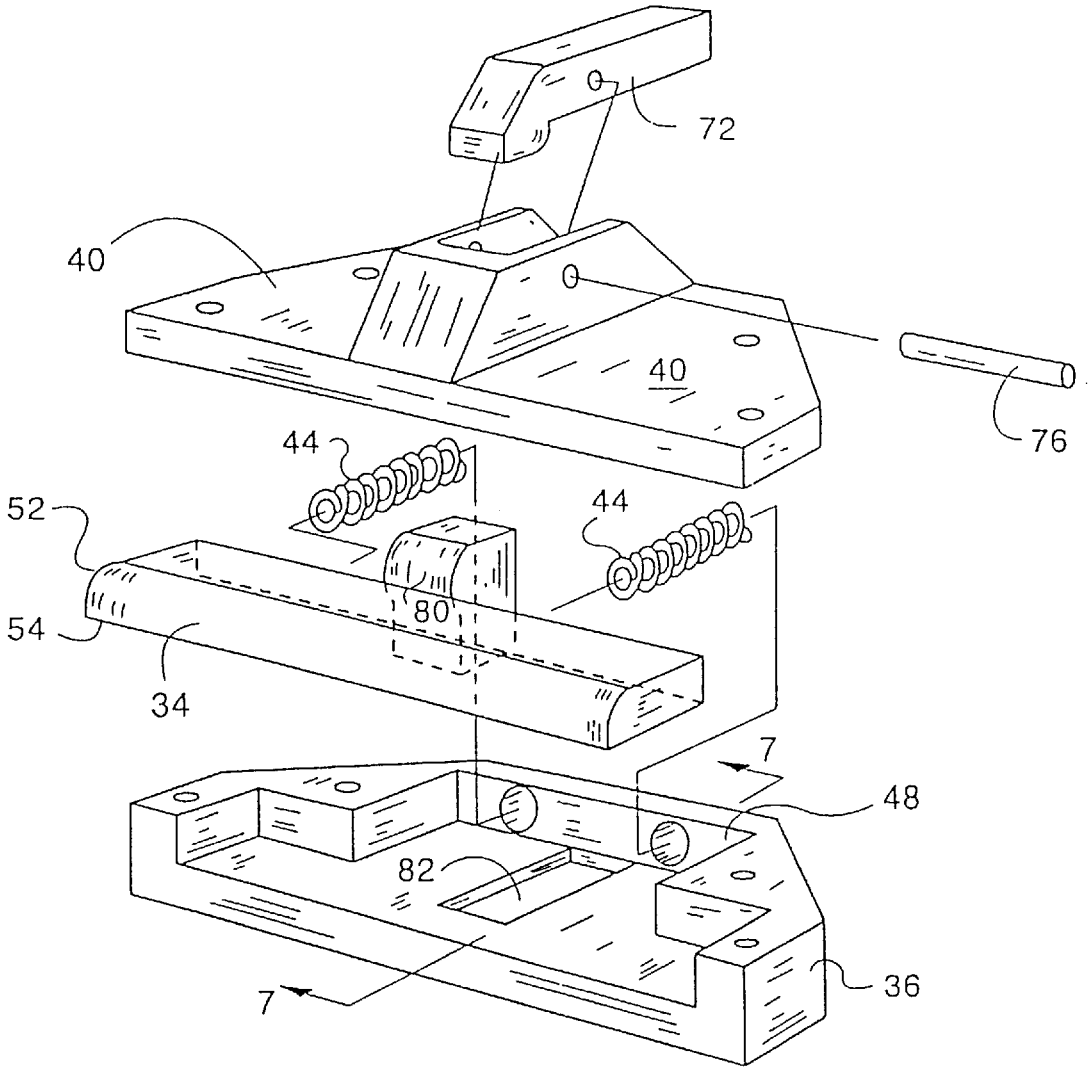
FIG. 3B shows an exploded view of a side engaging mechanism 32.
Figure 4:
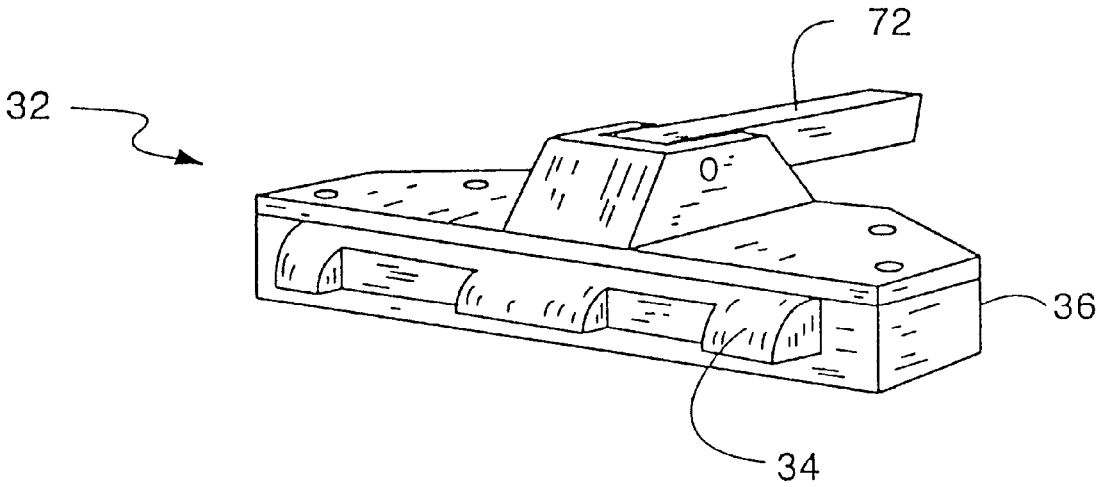
FIG. 4 shows an alternative, "toothed" embodiment of the engaging member 34 of the present invention.

The present invention is, at least in part, directed to a snowboard binding system 20 (e.g., FIG. 1) that allows a snowboarder to step into the binding system and thereby securely lock a snowboard boot 24 to restrain the boot from vertical and horizontal movement in relation to a snowboard 28. In one embodiment of the present invention, the snowboard binding system 20 includes a boot side engaging mechanism 32 (e.g., FIGS. 1, 3A) for binding a snowboard boot 24 to a snowboard 28. As best shown in FIGS. 3A and 3B, the engaging mechanism 32 includes an engaging member 34 housed in an engagement housing 36 and enclosed therein by the housing top 40. Further, the housing 36 is preferably fastened to or integral with a boot positioning plate 38 which is, in turn, fastened to the upper surface of a snowboard 28 in a conventional manner. The engaging member 34 is secured within the housing 36 so as to reversibly move between a first and a second horizontal positions, wherein in said first position the engaging member is extended outward from the housing 36 and said second position the engaging member is retracted into the housing. The engaging member 34 can be of any suitable design. For example, it can be tongue-like (as in FIG. 3A) or, alternatively, toothed-like (as in FIG. 4). The engaging member 34 is placed under tension, for example, by one or more springs 44 (FIG. 3B) biased against an opposing wall 46 of the housing 36, urging said engaging member 34 into said first position. Other suitable tensioning means can be utilized, such as elastic plastic, metal or rubber components that reversibly compress, extend or rotate when pressure is applied. In a preferred embodiment, therefore, the engaging member 34 is horizontally movable, rather than rotationally movable as in various prior art binding devices. Furthermore, the engaging member 34 is configured, in one embodiment, so as to have a top surface 52 (e.g., the surface furthest away from the snowboard 28) with a curved, rounded or slanted (hereinafter referred to generally as being slanted) shape and a bottom surface 54. The curved or slanted shape facilitates the horizontal movement of the engaging member 34 in a horizontal direction (and thereby into the housing 36) when vertical pressure is applied by the downward force of the sole of a snowboarder's boot 24. In this regard, note that the tension urging the engaging member 34 into the first position is preferably chosen so that the weight applied by a snowboarder is sufficient to move the engaging member from said first position to said second position by merely stepping into the binding system 20. Thus, assuming the sole of the snowboarder's boot 24 is configured with an embodiment of a boot connecting unit for connecting the boot 24 with the binding system 20 by compatibly engaging with the engaging member 34, when the connecting unit contacts the engaging member 34 with sufficient downward force, the engaging member is urged from the first position to the second position. Subsequently, the springs 44 to move back into the first engaging position, thereby locking the connecting unit and the boot 24 into place with respect to the snowboard 28.

In a preferred embodiment, there is an audible "click" indicating to the snowboarder that engagement of the boot into the binding system 20 has been achieved. In addition, and as described below, various other visual indicators can be used to indicate to the snowboarder that the boot and binding are in a secured arrangement, for example different colored segments of the engaging member which appear or disappear depending upon whether engagement is achieved. Electronic signals of a audible or visual nature can also be utilized to indicate whether the snowboarder's boot is properly engaged with the binding.

Figure 20A:
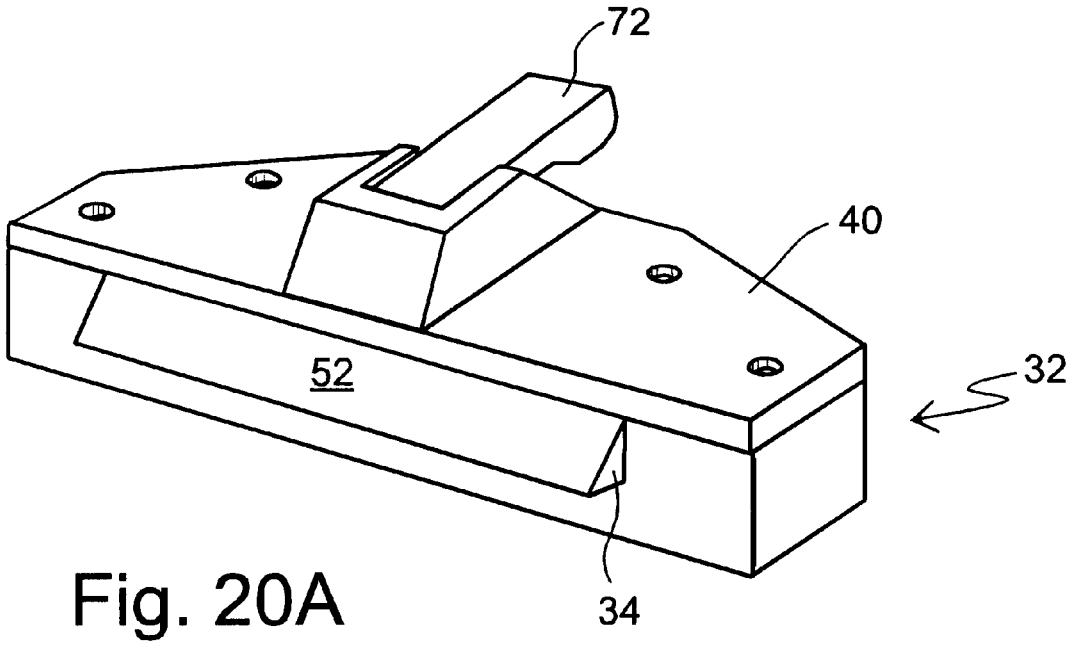
FIG. 20A is a perspective view of an engaging mechanism 32 having an engaging member 34 with a slanted top surface 52.
Figure 20B:
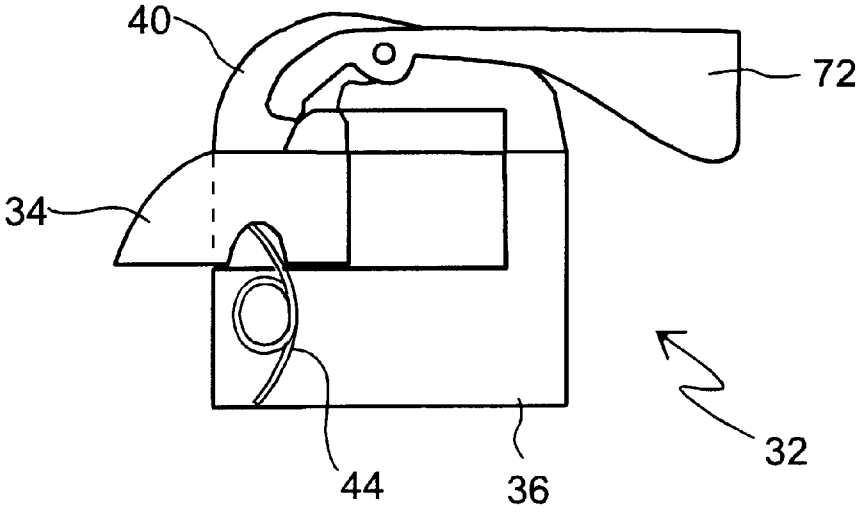
FIG. 20B is a side view of an alternative embodiment of the engaging mechanism 32 wherein a circular spring 44 is utilized to bias the engaging member 34 outward from the housing 40.
Figure 20C:
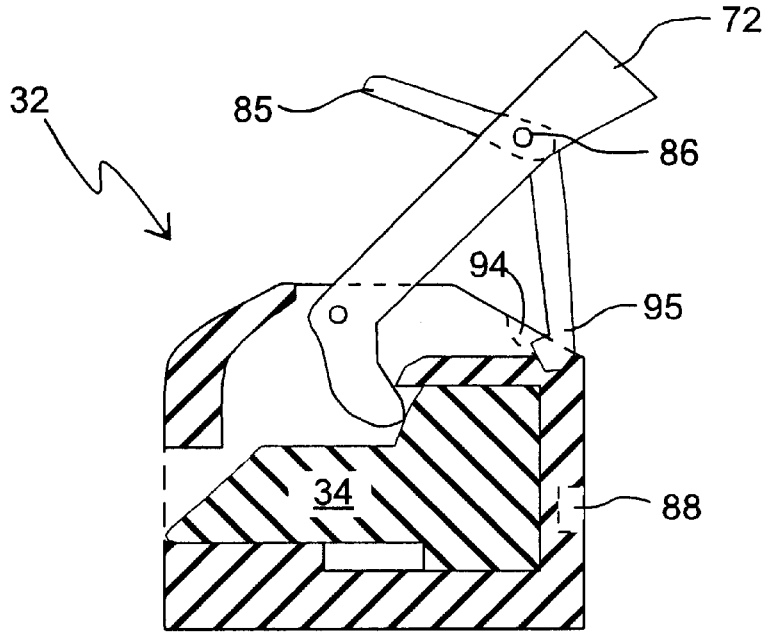
FIG. 20C is a side view of a locking mechanism illustrating how an engaging member 34 can be maintained in a retracted state by a finger locking mechanism.
Figure 20D:
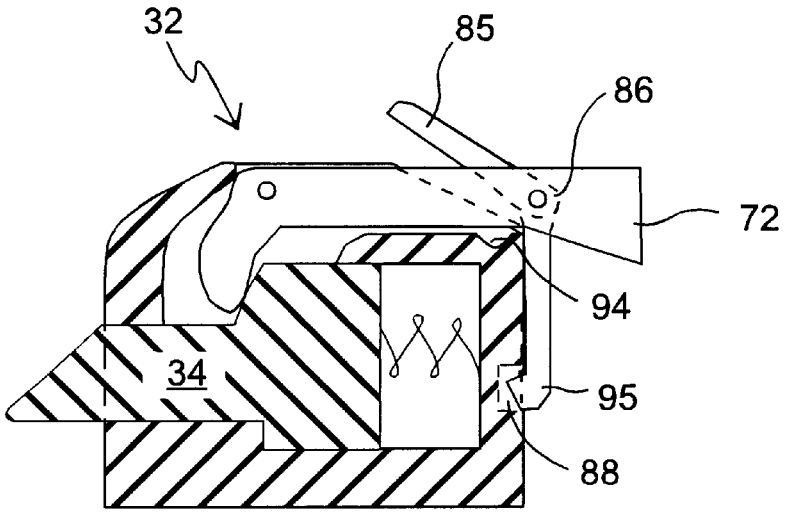
FIG. 20D is a side perspective view of the finger locking mechanism as shown in FIG. 20C where the engaging member 34 is locked in an engaged position.

Additionally, note that the engaging member 34 can also have a more angularly shaped top surface 52 that, like the curved, rounded or slanted shape described above, also facilitates the movement of the engaging member 34 into the housing 36 when a snowboarder's boot 24 is pressed downward onto the snowboard. In other words, a slanted top surface of the engaging member 34 facilitates the movement of the engaging member 34 in a manner that permits the boot 24 to move downwardly into an engaging position. Illustrations of such a slanted top surface 52 are shown in FIGS. 20A, 20C and 20D.

Another embodiment of the present invention is directed to engaging members that have a square shape but that interact with rounded, curved or slanted portions of a boot, thereby facilitating the movement of the engaging member 34 into a retracted position.

In at least one embodiment, engaging members 34 are positioned a predetermined distance above a snowboard surface so that any snow and ice buildup on the snowboard does not interfere with the operation of the engaging member.

In fact, one embodiment of the combination snowboard binding system 20 and the boot 24 of the present invention provides for engagement of a snowboarder's boot 24 to the binding system so that the distance between the human flesh of the snowboarder's foot is less than about 1½", more preferably less than about 1", and most preferably less than about ½" cm from the top surface of a snowboard 28 when a snowboarder's boot is engaged with the binding system. A primary advantage of this aspect of the invention is that being physically close to the surface of a snowboard 28 provides better "board feel" (i.e., snowboard control, stability and responsiveness) desired by both beginners and experts alike.

In yet another embodiment of the present invention, engaging members can be positioned on a snowboard surface so that each engaging mechanism 32 is separately mounted on the surface on respective sides of a snowboarder's boot 24. In this manner, the snowboarder's boot can be in direct contact with the snowboard surface.

Note that an engaging member 34 of the present invention, although preferably an elongated member that affords desired support along the length of a snowboarder's foot, may in some embodiments also comprise one or more pin-like structures that can either be retractable (e.g., spring biased) or can be fixably attached to a boot 24. Accordingly, when there is contact between such a pin-like structure and the binding system 20, the movement of an engaging member 34 is facilitated in a manner to secure the boot 24 to the binding system 20. Note that the pin-like structures should preferably have either a slanted or rounded surface to facilitate movement into an interlocking relationship with the binding system.

Figure 5:
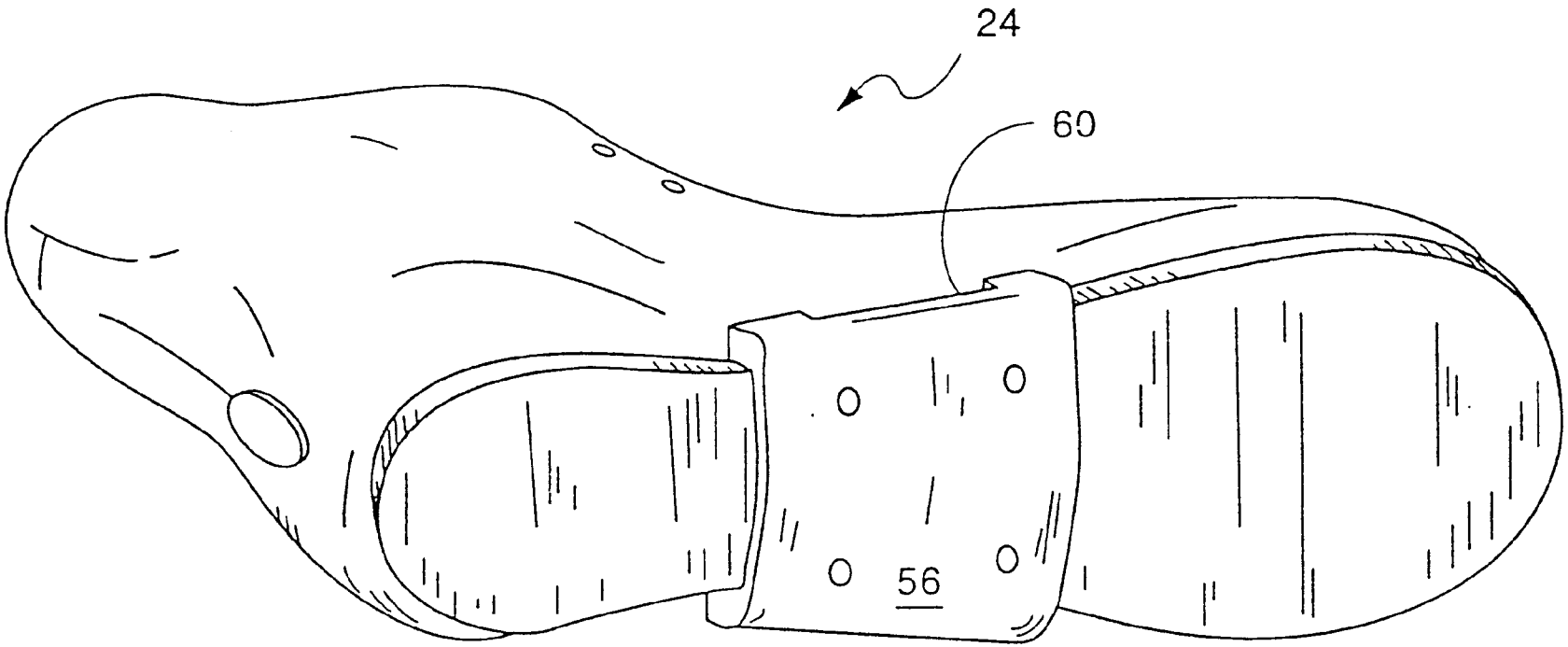
FIG. 5 shows a sole of a boot 24 having a boot plate 56 attached thereto.
Figure 6:
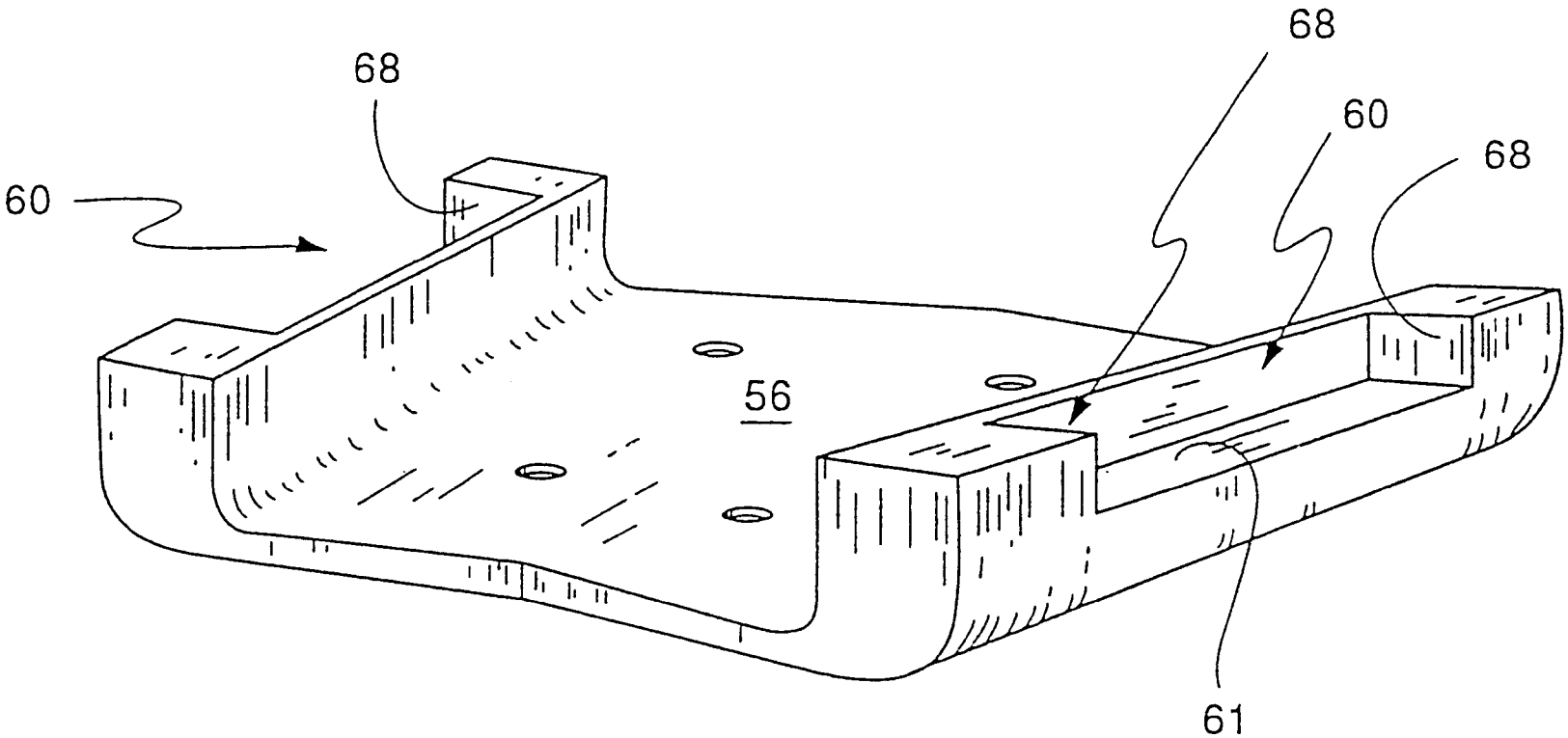
FIG. 6 is a perspective view of the boot plate 56.
Figure 19A:
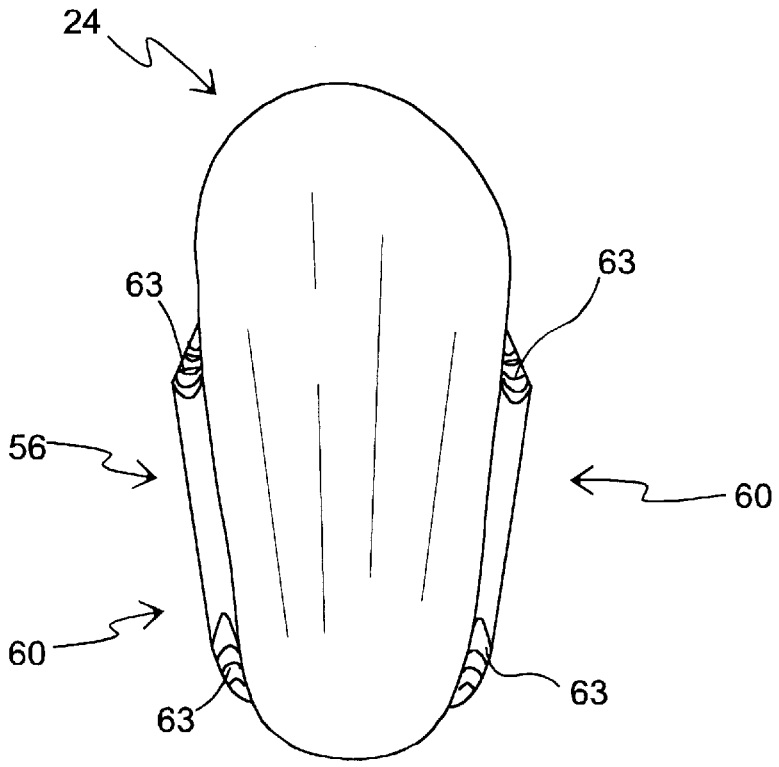
FIG. 19A shows a bottom view of a snowboard boot 24 with laterally extending receptacles or protrusions 60 and angled positioning contours 63 that mate with positioning keys 64 (shown in FIG. 19B) on the boot plate.

Note, in one embodiment, the connecting unit includes a boot plate 56 attached to the sole of the boot (e.g., FIGS. 5 and 6) wherein the boot plate has receptacles 60 formed therein that are capable of receiving the engaging members 34. Each receptacle 60 includes at least a shelf 61 that fits against the bottom surface 54 for securing the boot 24 to the snowboard 28. Additionally, in some embodiments, a receptacle 60 may also include side walls 68. Further, a receptacle 60 may be recessed, being substantially interior to the footprint of the boot 24 (e.g., as in FIGS. 17 and 22A–C) or, alteratively, may be extended laterally outside the boot footprint (e.g., as in FIGS. 5, 19A and 25B). Thus, in operation, the sole of the snowboarder's boot 24, having a boot plate 56, is forced downwardly upon the top curved surface 52 of the engaging member 34, forcing the engaging member into the retracted (second) position within the housing 36. Subsequently, after the boot plate 56 passes over the lower edge 64 of the engaging member 34, the engaging member is free to extend outwardly from the housing into the receptacle 60 formed in the boot plate. The engagement of the engaging member 34 into the receptacle 60 therefore restrains the snowboarder's boot 24 from vertically moving away from the snowboard 28.

Figure 19B:
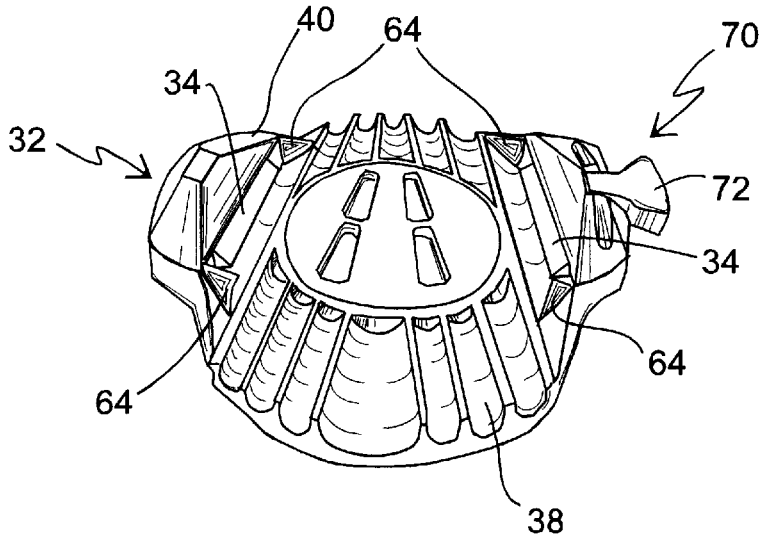
FIG. 19B is a perspective view of the boot positioning plate 38 showing two active engaging mechanisms 32 with one side having a retraction mechanism 70.

Alternative embodiments for securing the boot plate 56 and boot binding system 20 are shown in various groups of Figures. In particular, one alternative embodiment is shown in FIGS. 19A, 19B, 25A and 25B, wherein the boot plate 56 is integrated into the sole of the boot 24 and receptacles 60 may be viewed as laterally extending protuberances having, in addition to shelves 61, an underside 62 having positioning contours 63 (best shown in FIGS. 19A and 25B) that mate with positioning keys 64 (best shown in FIGS. 19B and 23). Note that by having the surfaces of the positioning key 64 angle outwardly as the surfaces rise away from the boot positioning plate 38, the full mating of the positioning contours with the positioning keys is made easier on the snowboarder. The positioning keys act as guidance ramps or surfaces to properly orient a boot into proper binding engagement. Note that FIGS. 19B and 23 also show the outward angular orientation of the positioning keys 64, and FIG. 19A (and, in an alternative embodiment of the boot plate 56, FIG. 22C) best shows that the mating angled positioning contours 63. Accordingly, the positioning keys 64 are angled in such a manner that a snowboarder's boot 24 is directed to a central focal point as the snowboarder's boot descends down into an engaging position with the binding system 20. Further, the inside portion of each engagement housing 36 that is adjacent to the boot 24 may also be slanted (as shown in FIG. 19B) so that opposing and opposite edges 64 of the housing 36 have approximately the same angle, preferably around 10–30° in relation to the longitudinal axis of the engaging member 34.

Note that the alignment means of the mating positioning contours 63 and keys 64 can be of substantially any shape wherein the snowboarder's boot 24 naturally glides into proper position with the binding system 20. In one embodiment, such alignment means can be positioned on the interior side of each engagement housing 36 and can be of various heights above the snowboard 28, preferably just high enough to properly guide the boot 24 into proper engaging position with the binding system 20 and more particularly the engaging mechanism(s) 32.

Also note that such mating of the positioning contours 63 and the positioning keys 64 may be used not only for properly aligning the boot 24 when entering the binding system 20 but also for assisting in maintaining proper horizontal alignment between the boot and the binding system. Accordingly, such mating of boot and binding system also acts as an impediment to horizontal movement of a snowboarder's boot 24 once secured into the binding system 20. As such, the engaging member 34 itself is not necessarily required to restrain both vertical and horizontal movement, but can be utilized solely to engage a snowboarder's boot into the binding system for preventing vertical movement, while the positioning contour and key structures prevent horizontal movement. Thus, such mating acts to inhibit undesirable movement of a snowboarder's boot 24 during turns and also help facilitate the "board feel" desired by snowboarders.

Additionally, each receptacle 60 may also have opposing side walls 68 (FIG. 6) that inhibit horizontal movement of the snowboarder's boot 24 once the engaging member 34 is fully engaged with the receptacle. In yet another embodiment, the upper surface of the snowboard 28 may be fitted with static elements, such as boot position braces of various types that preclude horizontal movement of the snowboarder's boot 24, while vertical restraint of the snowboarder's boot is achieved by engagement of the engaging member 34 with the receptacle 60 attached to or integral with the sole of the snowboarder's boot.

In one aspect of the present invention, the mating of the boot 24 (more particularly, boot plate 56) with the binding system 20 provides for the engaging member 34 and its corresponding receptacle 60 to be of any one of various lengths as measured along the axis corresponding to the length of a snowboarder's boot when connected by the binding system 20. However, the engaging member(s) 34 on each side of the boot 24 should preferably be of a sufficient length and position appropriately along the side of the boot 24 to hold the boot in a stable position when engaged by the snowboard binding system 20. Preferably, this length extends between about 10% to about 100% of the length of a snowboarder's boot, more preferably between about 10% to about 75% of the length of the snowboarder's boot, and most preferably at least about 15% of a snowboarder's boot. Given possible configurations of the mating combination of the receptacle 60 and the engaging member 34 (e.g., a lock and key configuration, or a configuration having interlocking projections such as teeth or pins), it is within the scope of the present invention to have more than one engaging member 34 on a side along the length of a snowboarder's boot. Furthermore, it is also within the scope of the invention that one or more active or movable portions for engaging the boot 24 to the binding system 20 may be on the boot itself. In one embodiment, such active sites may be both on the boot 24 and as part of the binding system 20. For example, on a side of a boot 24 there may be three locations for engaging the boot and the binding system 20, one such location having the active site in the binding system, a second having the active site on the boot and a third location having active sites on both the boot and the binding system.

Any suitable means can be utilized to accomplish retraction of a reversibly horizontally movable engaging member 34 when the boot 24 is locked to the binding system 20. Such means can include, for example, levers operatively associated with engaging members to pull such members out of an engaging position (as will be discussed hereinafter). Other means of retraction can include string or wire devices that allow the user to pull on the string in order to disengage one's boot from a binding. Push button and electronic means can also be utilized to achieve disengagement of a boot from a binding.

In one embodiment (e.g., FIGS. 3A, 3B), a retraction mechanism 70 includes a lever 72 that is pivotally connected to the housing 36 via pin 76 (FIG. 3B) for moving the engaging member 34. Although either downward or upward movement of such a lever 72 can be relied upon to retract an engaging member 34, downward movement is not preferred due to the possibility that accidental operation of such a lever is more likely to occur in normal use. Upward lever movement is therefore preferred to thereby cause pivotal rotation of the lever 72 so that the lever presses against a protrusion 80 (FIG. 3B) formed on the engaging member 34. Such pressing causes the protrusion 80 to slide within the horizontal slot 82 (FIG. 3B), thereby assuring that the engaging member 34 retracts without binding or kinking in the housing 36. Thus, the engaging member 34 is forced into a retracted (second) position upon upward pivotable movement of the lever 72. Note that the lever 72 is preferably designed so that a gloved hand can easily operate the lever.

Figure 7:
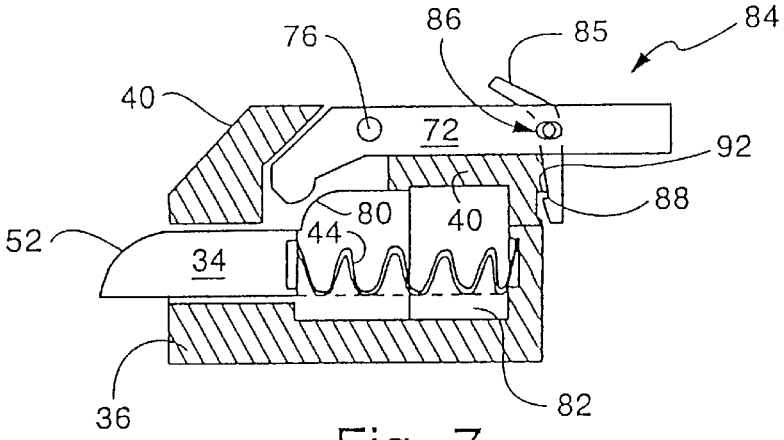
FIG. 7 shows a cross section of the side engaging mechanism 32 obtained by cutting vertically through the side engaging mechanism 32 along the line labeled 7 in FIG. 3B.

To prevent undesired upward movement of the lever 72 during snowboarding, any suitable locking means can be utilized. Preferably, two opposite forces are required to disengage the locking means, for example pushing down first on finger lever 85 and then pulling up on lever 72. For example, a suitable locking means includes "finger locking" mechanism 84 (FIG. 7) including a finger lever 85, a retaining contact 88 and a circular spring 86. Accordingly, the finger locking mechanism 84 can be used to prevent the lever 72 from moving in a vertically upward motion due to: (a) the mating of the retaining contact 88 with the finger lever 85 on a top surface 92 of the engagement housing top 40, and (b) the biases of the finger lever 85 by the circular spring 86 in a clockwise direction (i.e., toward the retaining contact 88).

Additionally, in some embodiments the lever 72 may be locked in an "open" position whereby the engaging member 34 is maintained in a retracted state. For example, FIGS. 20C and 20D illustrate a detent 94 that may be used in locking the lever 72 in the open position. Thus, since the circular spring 86 biases the finger lever 85 in the clockwise direction, if the snowboard user rotates or raises the lever 72 sufficiently, the locking nub 95 will automatically enter the detent 94 and thereby lock the engaging member 34 in the retracted position. Various other locking mechanisms can also be used to achieve the desired maintenance of an open position (e.g., retracted engaging member) whether the member 34 is located on a boot or on the binding. The open position facilitates a snowboarder's ease in loading onto a chair lift and in using a free foot for propulsion since a boot can be lifted to and from the binding without being in binding engagement.

Figure 8:
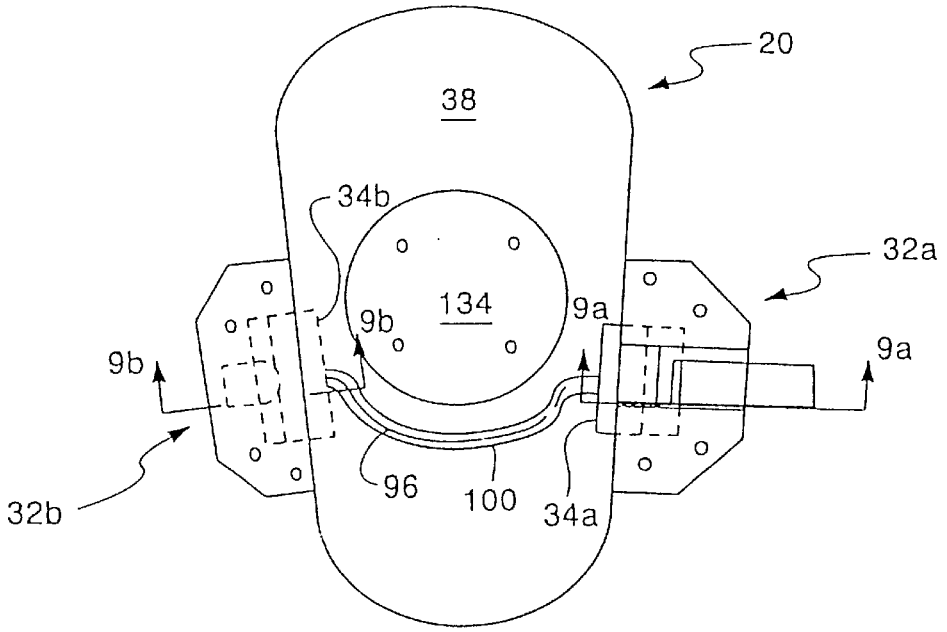
FIG. 8 is a top view of the binding system 20, wherein there are two opposed side engaging mechanisms.
Figure 9:
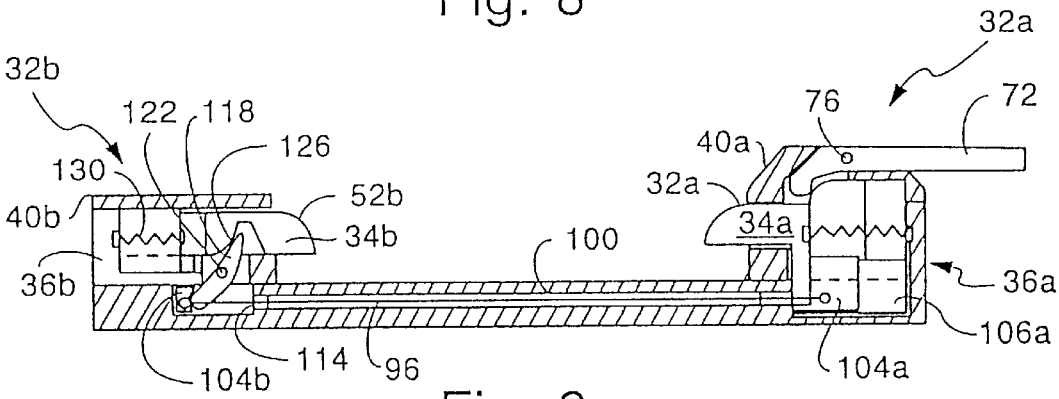
FIG. 9 is a cross section of the embodiment shown in FIG. 8. In particular, the cross section of side engaging mechanism 32*a* is through line 9*a* of FIG. 8 and the cross section of side engaging mechanism 32*b* is through line 9*b* of FIG. 8.

In one particular embodiment, shown in FIGS. 8 and 9, the binding system 20 of the present invention is provided with opposed active engaging members 34*a,* 34*b* that interact with each lateral side of a snowboarder's boot 24 in a similar manner to engaging member 34. Thus, preferably, each engaging member 34*a,* 34*b* has an upper curved or slanted surface 52*a,* 52*b,* similar to the top curved surface 52, or a slanted surface 52 as in FIG. 20A, respectively, such that upon downward pressure supplied by the weight of the snowboarder's boot 24, each engaging member 34*a,* 34*b* is forced into their respective housings 36*a,* 36*b,* allowing the snowboarder's boot to move vertically downward into contact with the upper surface of the snowboard 28 and/or the binding system 20, whereby the engaging members 34*a,* 34*b* are allowed to extend horizontally toward the boot 24 and into a locking, engaging position with receptacles 60 on both sides of a boot plate 56 (or, more generally, compatible connecting unit) on the boot sole. This particular embodiment avoids the necessity that a snowboarder angularly position his/her snowboard boot sole so as to hook one lateral edge under a static restraining member and then pivot the sole of their boot to operate an active engaging member on the opposing lateral side of their boot. It should be appreciated that the duo-sided active engaging binding described herein can utilize not only the horizontally engaging member arrangement described herein, but also other engaging-type mechanisms, such as those that rely upon a pivoting or rotational engagement mechanism between a snowboarder's boot sole and binding. The present inventor is the first to appreciate that two laterally opposed active engaging members facilitates far easier binding of a snowboarder's boot 24 to the surface of a snowboard. As discussed below, the duo-active side arrangement provides a safer design that allows for easier release of a snowboarder's boot 24 from the binding, for example, after a fall in deep snow. Release from the engaging sites provides for ready removal of a boot 24 from a snowboard 28 without requiring the need for any angular or slidable movement of the snowboarder's boot to disengage the boot from the binding system 20.

Still referring to the duo-active site binding embodiment of FIGS. 8 and 9, each separate engaging member 34*a*, 34*b* can be movable from a first engaging position to a second disengaging position by a lever 72 operably connected to at least one of the opposed engaging members. The operation of individual engaging members 34*a*, 34*b* can be coordinated by operatively connecting the engaging members such that retraction of one engaging member by a lever 72, for example, also acts to retract the other opposing engaging member. To accomplish this coordinated retraction of opposed engaging members 34*a*, 34*b*, one end of a cable 96 is attached to each of the engaging members. Operation of the lever 72 to retract the engaging member 34*a* also acts to pull the cable 96 in a manner that retracts the opposing engaging member 34*b*. This can be accomplished, for example, by running the cable 96 through a curved channel 100 and looping through (or otherwise attaching) the ends of the cable to slidable guides 104*a*, 104*b* that slide horizontally in slots 106*a*, 106*b*, respectively. (As an aside, note that guide 104*a* may be integral with engaging member 34*a*.) Thus, to accomplish the desired retraction of the opposed engaging members 34*a*, 34*b*, upon activation of the lever 72, slidable guide 104*a* is urged (by counterclockwise pivoting of lever 72 acting upon engaging member 34*a*) toward the slot surface 110. This, in turn, causes slidable guide 104*b*, via cable 96, to move toward slot surface 114 and thereby urge lever 118 to pivot counter-clockwise about a pin 122. In pivoting, the lever 118 contacts curved surface 126 and thereby causes engaging member 34*b* to retract and simultaneously to compress spring 130. Alternatively, when finger pressure is not applied to lever 72, then spring 130 causes engaging member 34*b* to extend, which in turn causes lever 118 to urge slidable guidelines 104*a*, 104*b* back to the positions shown in FIG. 9. Note that due to the conventional configuration of securing plate 134 (e.g., the portion of the boot positioning plate 38 that attaches a binding to a snowboard) under the mid-sole of a snowboarder's boot, one embodiment of the present invention (FIG. 8) has cable 96 connecting the two opposed engaging members wherein the channel 100 in which the cable resides is substantially semi-circular around the securing plate 134.

In yet another embodiment of the present invention, a spring 130 is positioned under the boot positioning plate 38, in contrast to the embodiment shown in, e.g., FIG. 8 wherein springs 130 are located on the sides of the snowboarder's boot 24. With the spring 130 located approximately underneath the snowboarder's boot sole, the spring may be operatively connected to one or more engaging members 34 in a manner that efficiently utilizes the limited area of a snowboard and that reduces the amount of hardware surrounding a snowboarder's engaged boot. Consequently, upon contact with receptacle 60 on a snowboarder's boot, such engaging members 34 stretch (or alternatively compress the spring 130 (attached to the one or more engaging members 34) so as to allow each engaging member to pass rearwardly into the receptacle 60, whereby each engaging member is then urged into an engaging position by the spring means into their corresponding receptacles 60. The accommodation of the spring 130 underneath the boot positioning plate 38 provides for a binding system 20 that may be less cumbersome and bulky.

Figure 10:
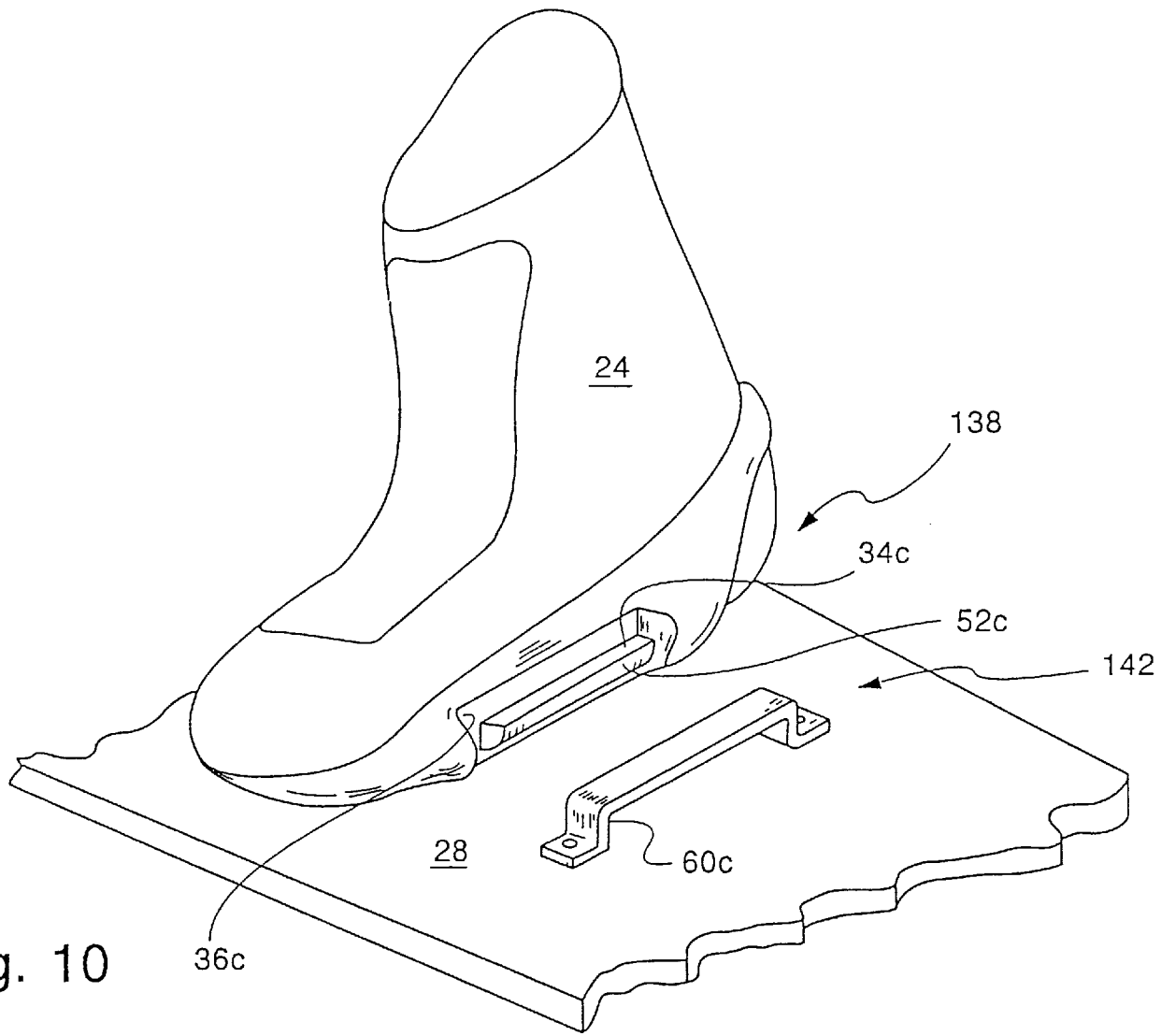
FIG. 10 shows an alternative embodiment of the present invention wherein the active engaging members 34*c* are fixably attached to the boot 24 rather than the snowboard 28.
Figure 11:
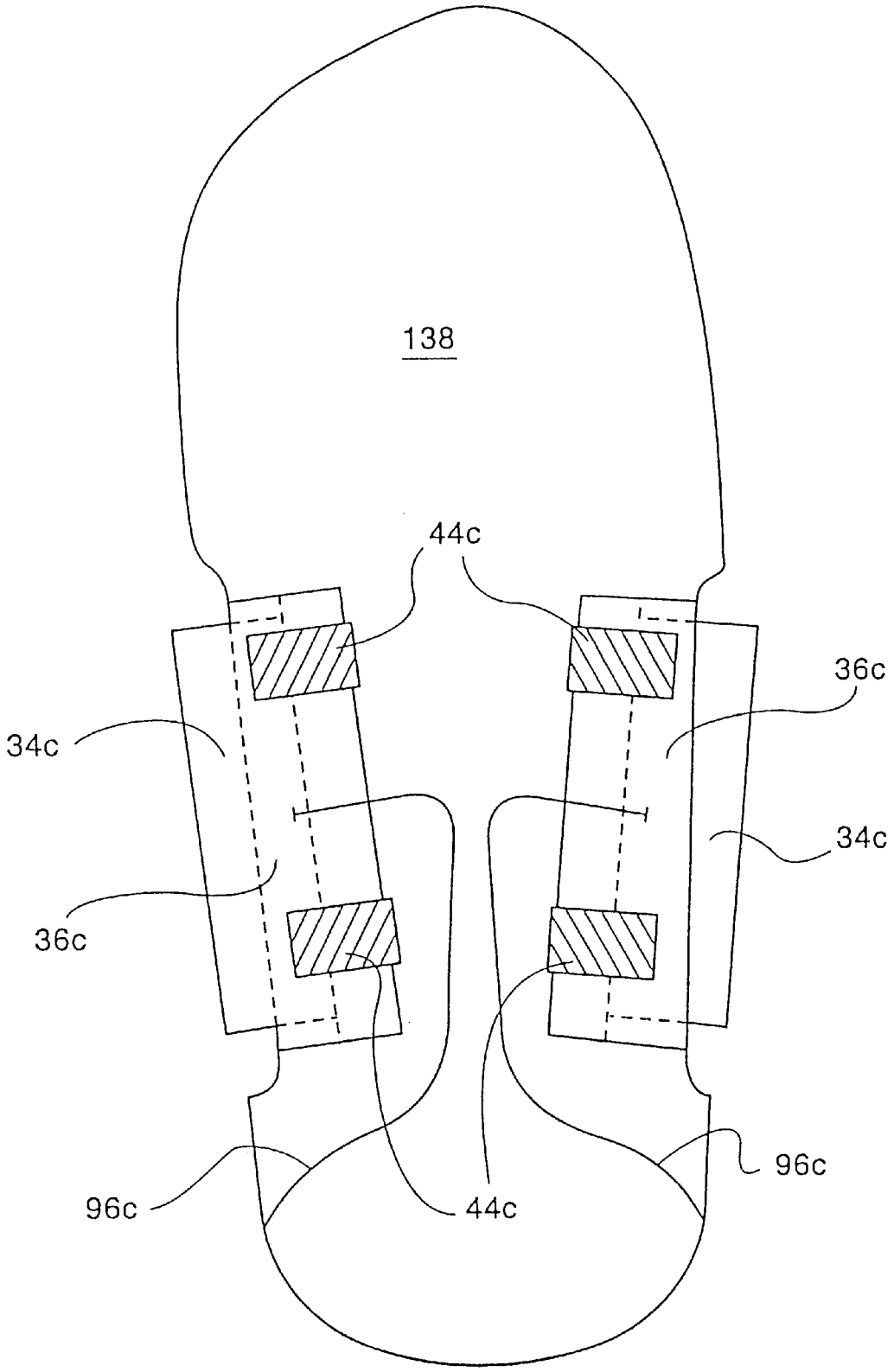
FIG. 11 shows a bottom view of the boot of FIG. 10 wherein the internal components related to the engaging members 34*c* are illustrated.
Figure 12:
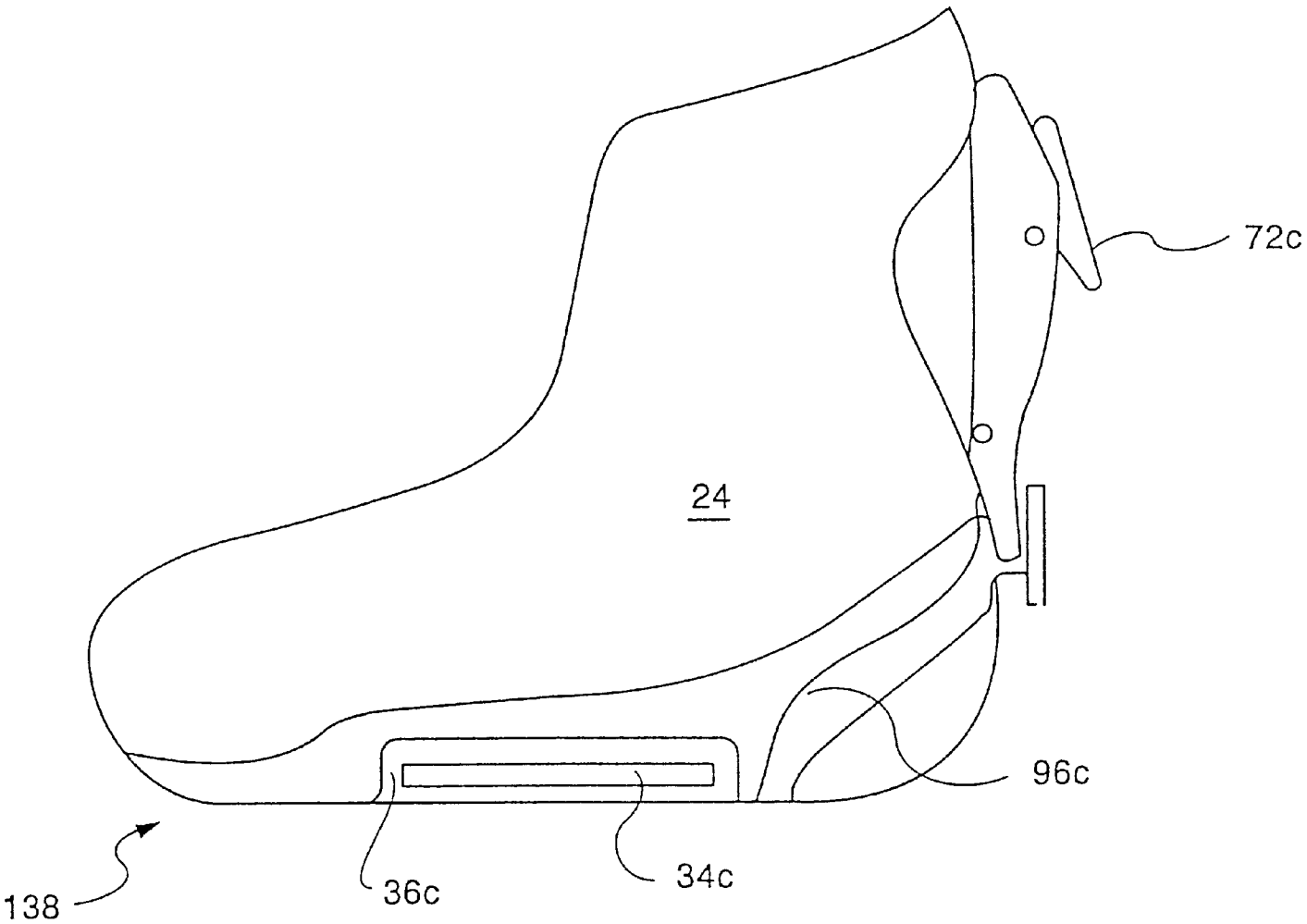
FIG. 12 is a side view of the boot 24 of FIG. 10.

In a separate embodiment of the present invention (FIGS. 10–12), at least one active engaging member 34*c* (FIG. 10) is integral with the snowboarder's boot sole 138, either by separately attaching such member to the sole of the boot, or by manufacturing the boot so that the sole has at least one active engaging member contained as a part of the sole. In such an embodiment, it is possible to have a static binding 142 attached to the snowboard 28 itself as shown in FIG. 10, thereby reducing the weight of the snowboard as compared to the weight of snowboards having bindings that have hardware components required to actively engage snowboard boots. Snowboard binding soles 138 (and/or retrofittable snowboard binding plates fittable to snowboard boots) can be of various configurations, including the embodiments described above, although the respective positioning of static binding 142 (or receptacles 60*c*) and engaging members 34*c* are reversed between the boot sole and the snowboard 28. Furthermore, a snowboard boot having the binding system of the present invention integral with the boot sole can have one active site on one side of the boot (the site on the other side of the boot being static) or, alternatively, the boot sole can have two active sites on each lateral side of the boot, as shown in FIG. 11, wherein components of the boot sole 138 with comparable functionality to the components of the active snowboard binding system 20 of FIGS. 1–9 are labeled with identical numbers but followed with a "c." Also note that in a preferred embodiment, the shape of the engaging member 34*c* will be such that a curved portion 52*c* of the engaging member is reversed from the position of the curved member 52 so that the curved portion 52*c* is directed toward the surface of the snowboard 28.

In operation, a snowboarder using a duo-active site sole can simply step into a static snowboard binding (e.g., static binding 142) attached to a snowboard 28 and the downward force of the snowboarder's weight will cause the curved surface 52*c* of the engaging members 34*c* to interact with the upper edge of two opposed static bindings on the snowboard, thereby moving the engaging members 34*c* from a first extended position to a second retracted position. Further downward pressure will cause the engaging members to move back into said first extended position after passing downwardly to a point where the engaging members 34*c* can extend into the receptacles or openings 60*c* of the two opposed static bindings.

In the present embodiment, the pair of receptacles 60*c* into which the engaging members 34*c* extend are not much further apart than the width of the snowboarder's boot. In other embodiments, however, in particular where duo-active engaging mechanisms are laterally spaced and affixed to the snowboard 28 (as in FIGS. 8 and 9), different configurations of static and active engaging mechanisms can be utilized. For example, an extended bar-like structure can be fitted on each side of a snowboarder's boot sole to pivotally engage with two opposing active sites secured to the snowboard 28.

Further note that the present binding system also permits visual verification of positive engagement of a boot 28 with the binding system, unlike numerous binding systems available on the market that are difficult to determine whether a boot is adequately secured to a snowboard. Clear windows (plastic) can be placed in top 40 of the housing 36 (also in top of 40*b*) through which colored portions of engaging members 34*a* and 34*b* will be visible. For example, red would be visible when not fully engaged and green visible when fully engaged.

As with the invention embodiment having engaging members 34 attached to the snowboard 28, the lever 72*c* which operates the reversible engagement of the engaging member(s) 34*c*, a locking mechanism (not shown) can also be provided so that unintentional disengagement of the engaging member(s) is precluded. Such a locking mechanism can comprise, for instance, a finger slidable member, preferably retractably tensioned with a circular spring that contacts a housing adjacent the pivotable mount of the lever 72*c*, thereby preventing the lever from an upward movement which would act to disengage the engaging member from a boot receptacle 60*c*.

Note that, regardless of where the engaging member(s) are located, such embodiments may utilize an open frame housing construction so as to provide for easy removal of snow and ice that may interfere with the operation of the engaging member(s).

It is also within the scope of the present invention to utilize different types of active engaging members 34 with a retro-fittable sole attachment and/or as an integral part of a snowboarder's boot sole so that a given snowboard boot 24 may be used with a variety of active engaging members 34. For example, pivotable binding structures such as those described in Raines, U.S. Pat. No. 4,973,073 or Glaser, U.S. Pat. No. 5,299,823, can be used instead of the horizontally moving engaging member 34*c* described herein. Although a snowboard boot sole preferably has such active bindings positioned on each lateral side, it is also within the scope of the present invention to have active binding mechanisms positioned at other lateral sole positions (e.g., such as at a heel or toe position) or any combination of toe, heel or side sites. By having active bindings formed integral with a snowboarder's boot, the weight of a snowboard is greatly reduced by eliminating the typically heavy binding mechanisms that are conventionally attached to the snowboard 28 itself. Snowboards can also merely be fitted with static structures that engage with active binding sites of a snowboarder's boot sole. Moreover, in one embodiment wherein the preferred positioning of the active binding is in the mid-side portions of a boot sole, normal walking action by a snowboarder is not impeded given that the mid-portion of a boot typically does not require flexibility. Side mounted bindings integral with a boot sole are preferably made of lightweight metal or hard plastic material and can also be retractable by movement of a lever 72*c* for positioning engaging members 34*c* entirely within the confines of the boot sole perimeter or, alternately, allowing the engaging members to extend.

Figure 14:
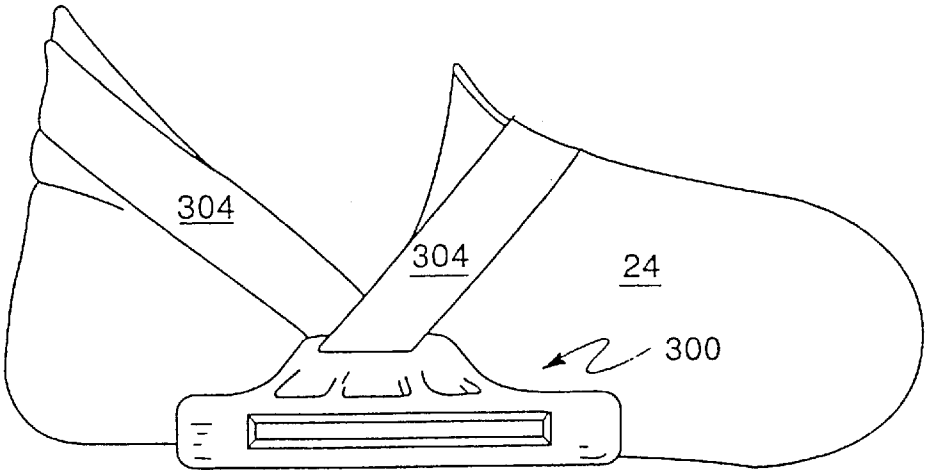
FIG. 14 shows a side view of the binding plate 300 attached to a boot 24.

Yet another aspect of the present invention involves the proper contact of a snowboarder's sole with the surface of the snowboard 28. Given the lateral engaging mechanisms and/or the connecting units such as the retro-fittable binding plates 300 described herein (FIG. 13), it may be necessary to provide elevated toe and heel structures to maintain the board feel for a snowboard rider since these portions of the boot 24 sole might not otherwise be supported as illustrated in FIG. 14. Therefore, to the extent that lateral side engaging bindings and/or connecting units, as set forth herein, require elevation of the snowboarder's sole above the surface of the snowboard, toe and heel projections can be positioned and affixed to the snowboard's upper surface so as to afford a relatively uniform horizontal plane for the boot sole once in locked engagement with the lateral engaging bindings.

The lateral engaging bindings of the present invention can also be adjustable about the conventionally circular securing plate 134 (e.g., FIGS. 8, 19A) found on typical snowboard designs. For example, the binding system 20 embodiment of FIG. 2 includes securing slots 200 through which mounting bolts (not shown), used for mounting a snowboard binding to the snowboard, are received. However, since the securing slots are elongated, the binding system 20 may be adjusted along the longitudinal axis 204. Moreover, the pattern of the securing slots 200 may take other configurations such that, for example, the binding system 20 may be adjustably rotated about center point 208. Moreover, the present binding system can be formed from a continuous, solitary piece of material so that both lateral sides, whether active or not, as well as any toe and heel elevated portions, are combined as a single unit.

Figure 18:
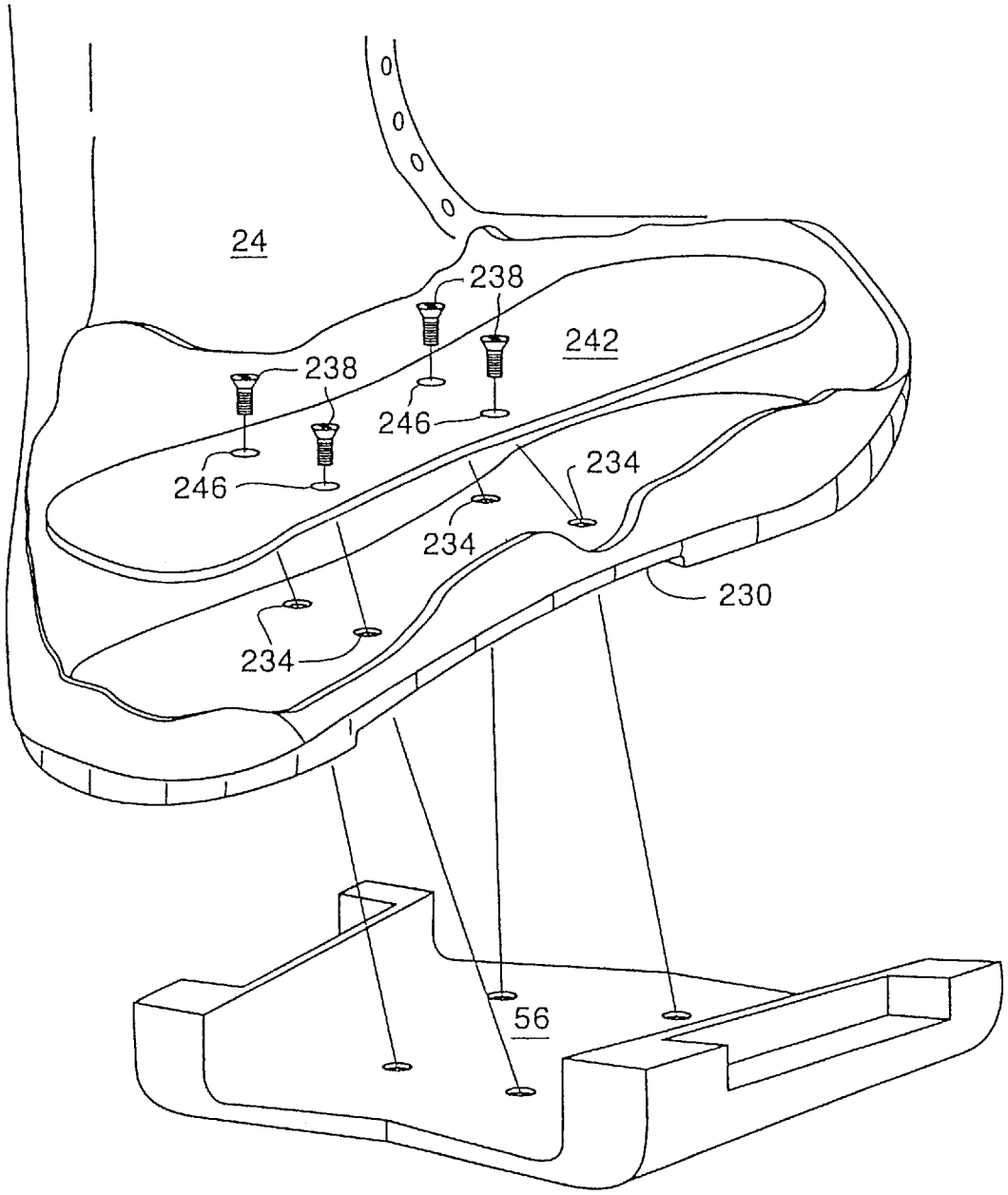
FIG. 18 shows one embodiment for attaching a connecting unit (e.g., boot plate 56) to a boot.

Connecting units can also be designed to be retro-fittable with various existing boot designs, thereby accommodating a snowboarder's boot preference. Desired stability and ruggedness is achieved by utilizing metal or hardened plastic for such plates. Attachment of such plates to the sole of a desired boot can be by screws, adhesives, etc. In one preferred embodiment shown in FIG. 18, an attachment is provided whereby a retro-fittable boot plate 56, for example, having static (or alternately active) lateral sides, as described above, is attached to a boot sole 230 by providing holes 234 in the sole through which screws or bolts 238 can pass. A metallic or hardened plastic sole member 242 is placed inside a snowboard boot 24, preferably below soft cushioning material used to protect a snowboarder's socked foot. The relatively rigid sole member 242 may have threaded apertures 246 (or, alternatively, the binding plate 56 can have threaded apertures) to receive the screws/bolts, thereby providing a secure attachment site for the boot binding plate.

Figure 21:
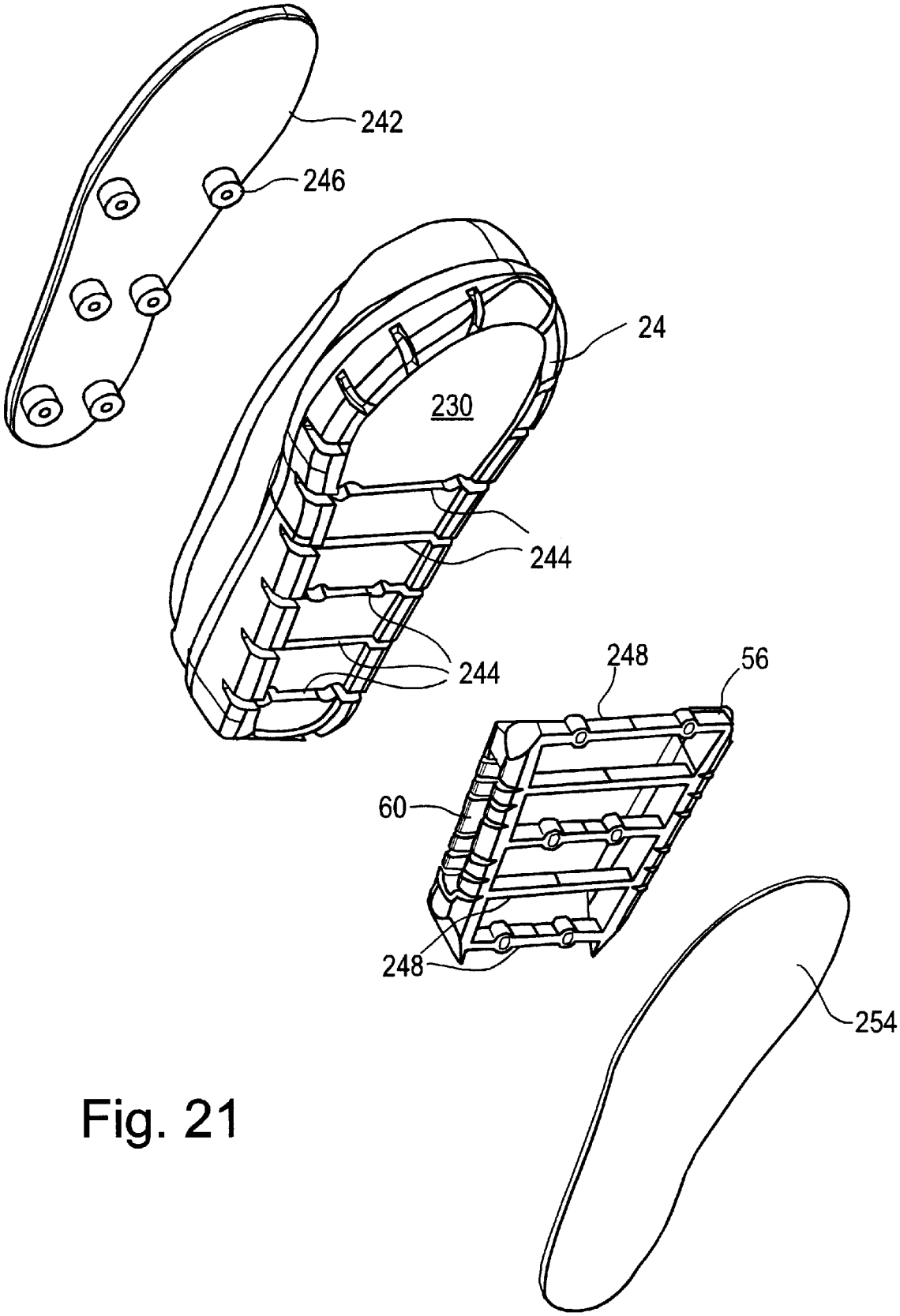
FIG. 21 is an exploded perspective view of a snowboard boot sole wherein a top layer next to the rider's foot has apertures that receive screws/bolts that pass through the boot sole into the boot plate 56 which is then covered with a boot sole tread.

Referring now to FIG. 21, a boot 24 is shown that has slots 244 extending across various widths of the boot's sole. Such slots 244 are designed so that the cross members 248 of the boot plate 566 shown in this Figure are received into the slots 244 thereby providing: (a) interchangeability of boot plates (if, for example, a different configuration of engaging members 34 requires a differently configured boot plate); (b) boot plates 56 that are substantially flush with the sole of the boot 24 (such boot plates 56 preferably countersunk (e.g., by ¼ inch) into the sole to afford rubber sole contact with the ground and/or surface of a snowboard or binding plate); and (c) boot plates 56 that are relatively lightweight. Thus, once the boot plate 56 is positioned with the cross members 248 in the slots 244, screws 238 (e.g., FIG. 18) may be used to secure the sole plate 242, the boot 24 and the boot plate 56. Subsequently and optionally, an underlaying additional 20 boot tread 254 may be affixed using any of a number of (re)soling techniques.

Figure 22A:
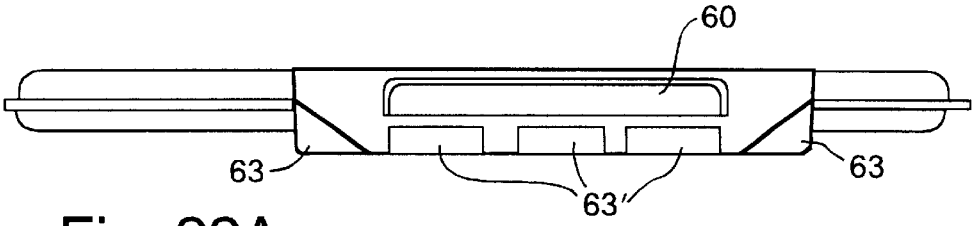
FIG. 22A is a side view of a binding plate 300 suitable to be insert modeled as part of a rubber boot sole, such view showing aligning ramps, a protrusion that can engage an engaging member and guide ramps for positioning the boot properly into a binding.
Figure 22B:
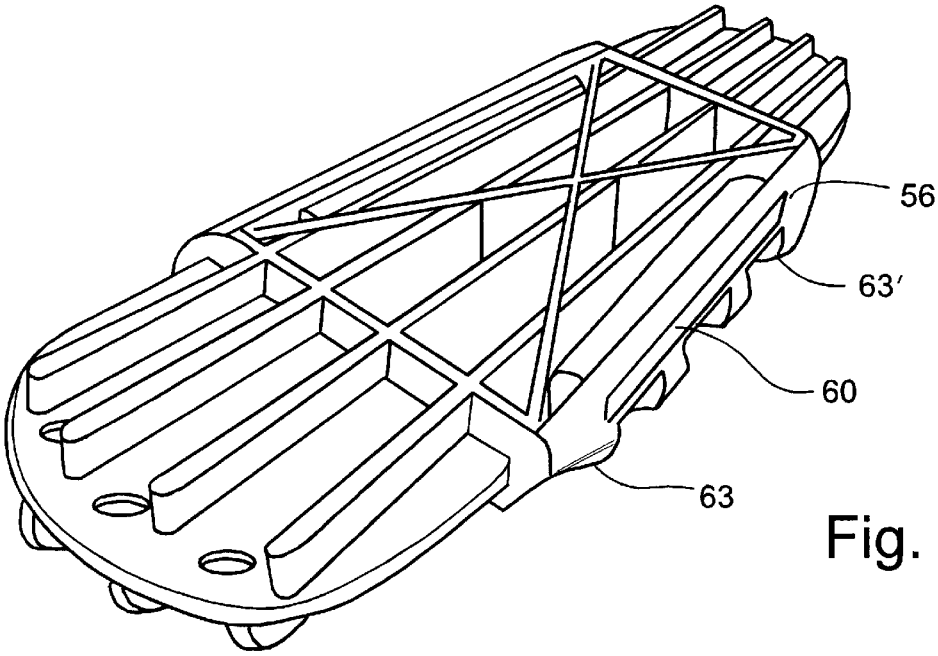
FIG. 22B is a perspective view of the top of a boot plate 56.
Figure 22C:
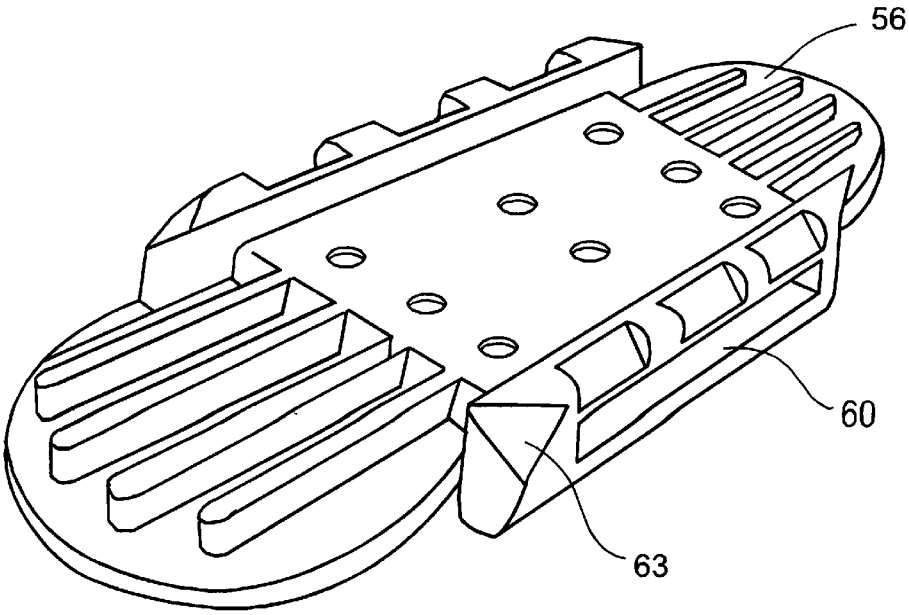
FIG. 22C is a bottom perspective view of the bottom of a boot plate 56.
Figure 23:
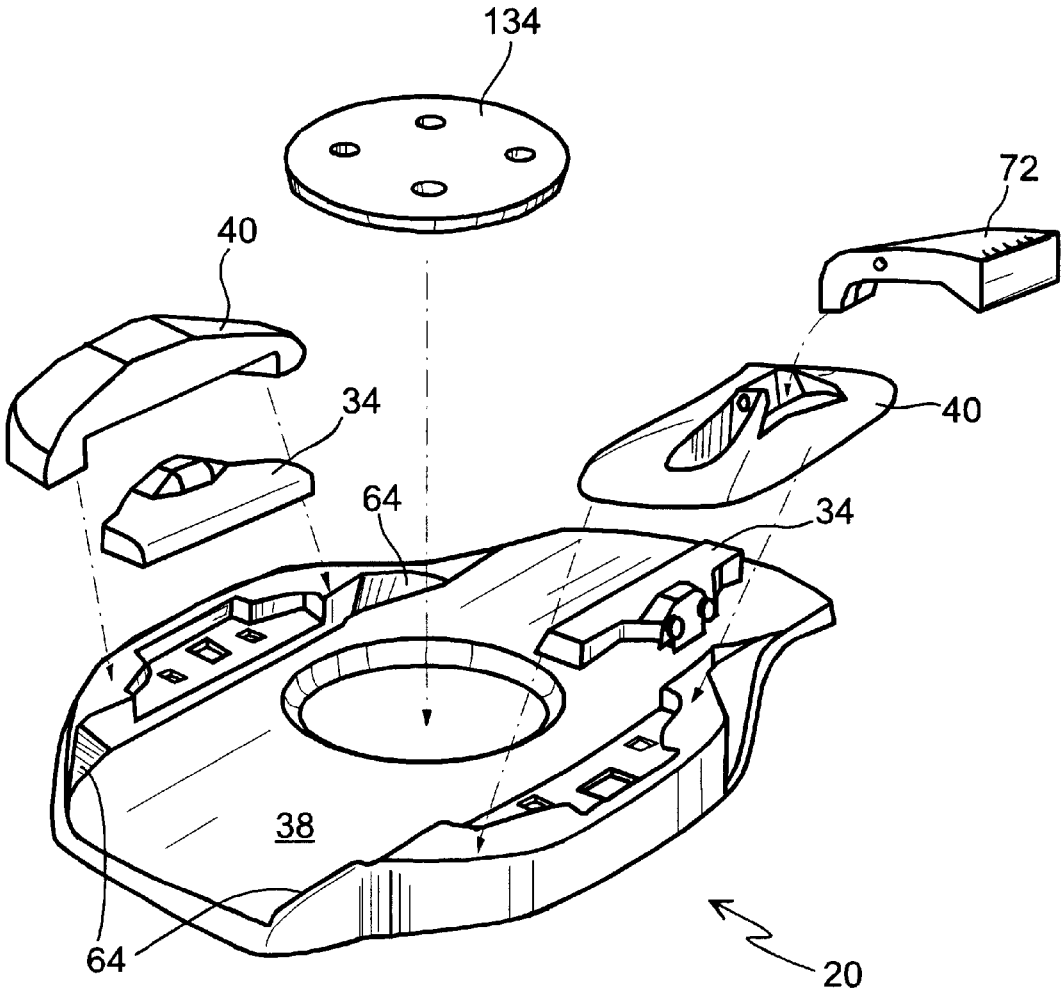
FIG. 23 is an exploded perspective view of one embodiment of the binding system 20 of the present invention.

Referring now to FIGS. 22A, 22B and 22C, an integrated boot sole and boot plate is shown which may be made an integral portion of a snowboard boot 24 when the boot is manufactured. Note that these Figures also illustrate an additional novel feature of the present invention in that there are positioning contours 63 of two different configurations illustrated. That is, those labeled 63 and those labeled 63'. Note that the additional new positioning contours 63' have, preferably, mating positioning keys 64 (not shown). Accordingly, the additional contours 631 increase the interlocking of the boot 24 with the binding system 20 and thereby increase the responsiveness of the snowboard 28 to a snowboarder's movements. Moreover, the positioning contours 63' are particularly useful in assuring alignment of the snowboarder's boot 24 in the binding system 20 since with any substantial misalignment the contours 63' will not mate with their corresponding positioning keys 64.

Figure 13:
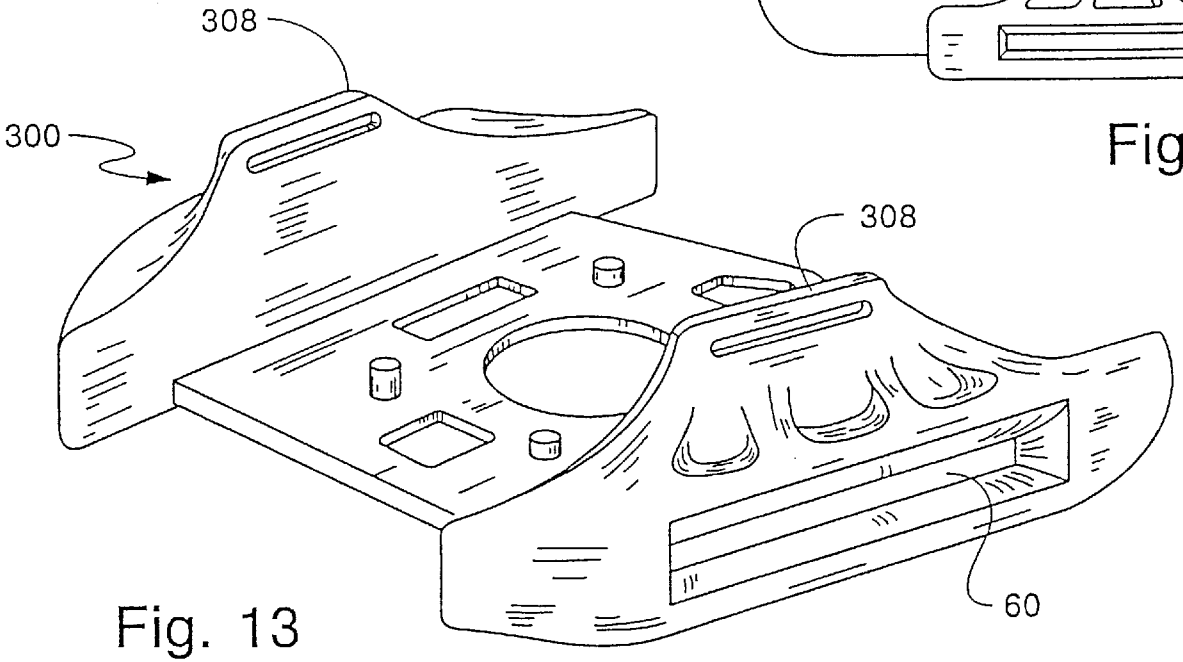
FIG. 13 shows a binding plate 300, retro-fittable to a conventional boot, wherein the binding plate locks into the binding system 20 on a snowboard. Thus, the binding plate 300 serves to attach the boot to the snowboard.

Alternatively, retro-fittable binding plates can be attachable to existing snowboard boots by means of adjustable straps. Thus, instead of having the connecting unit integral with the boot 24 as with the boot plate 56, the connecting unit may be separate from the boot, but retro-fittable to various boots. One such embodiment of a connecting unit is shown in FIGS. 13 and 14, that is, retro-fittable binding plate 300. This connecting unit, as can be seen in FIG. 14, attaches to the bottom of a boot 24 via, for example, velcro straps 304. As best shown in FIG. 13, the straps 304 lace through one or more strap holders 308 on each lateral side of the binding plate 300. Further, as with the boot plate 56, the binding plate 300 includes laterally positioned receptacles 60 for receiving the engaging members such as active engaging member 34.

Alternatively, boots can be manufactured having a connecting unit integrally molded into the sole, the connecting unit being made of hardened plastic, metal, or any other suitable material capable of withstanding the stresses encountered in snowboarding.

Figure 15:
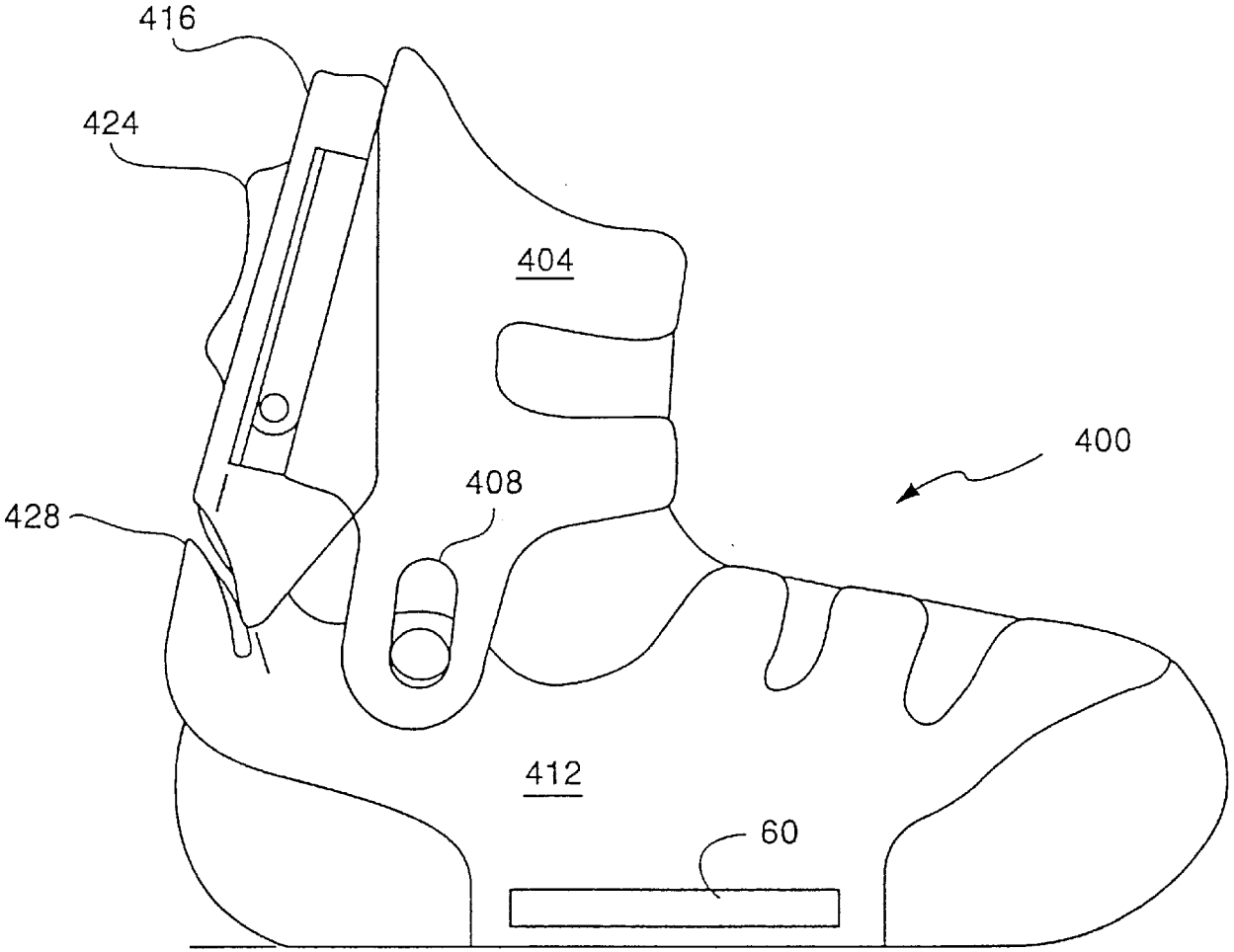
FIG. 15 shows a side view of a boot 400 suitable to be utilized with the binding system 20.
Figure 16:
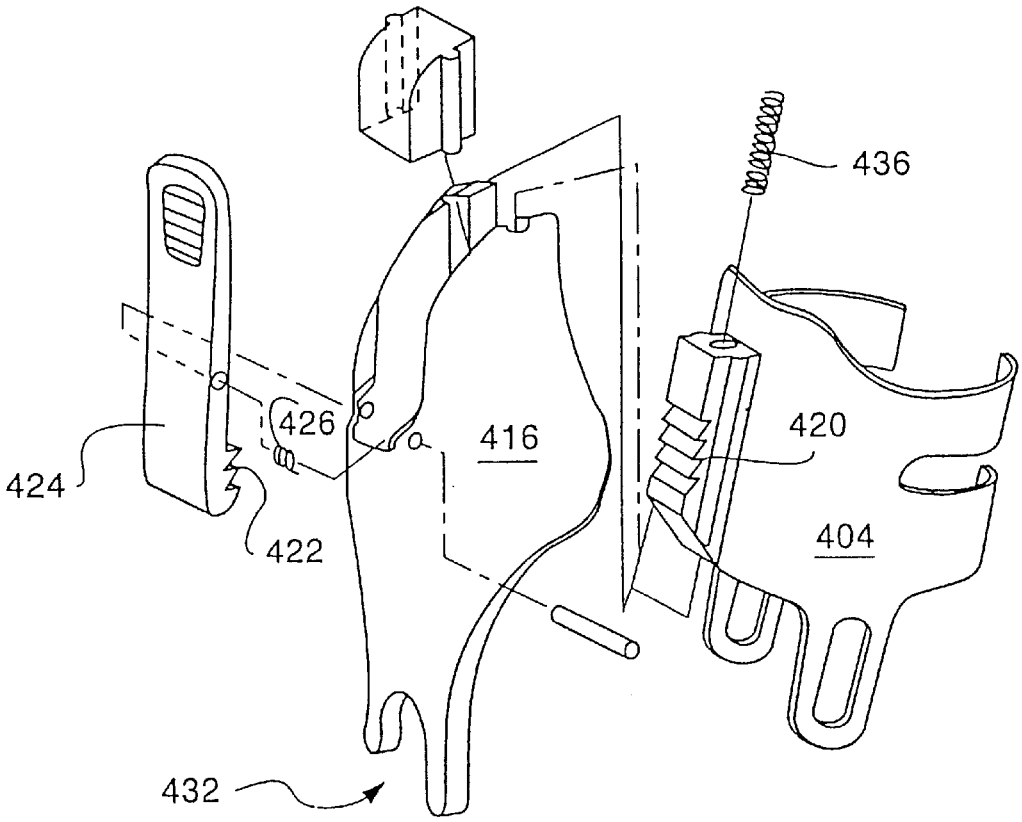
FIG. 16 shows a more detailed view of the high-back element 416.
Figure 17:
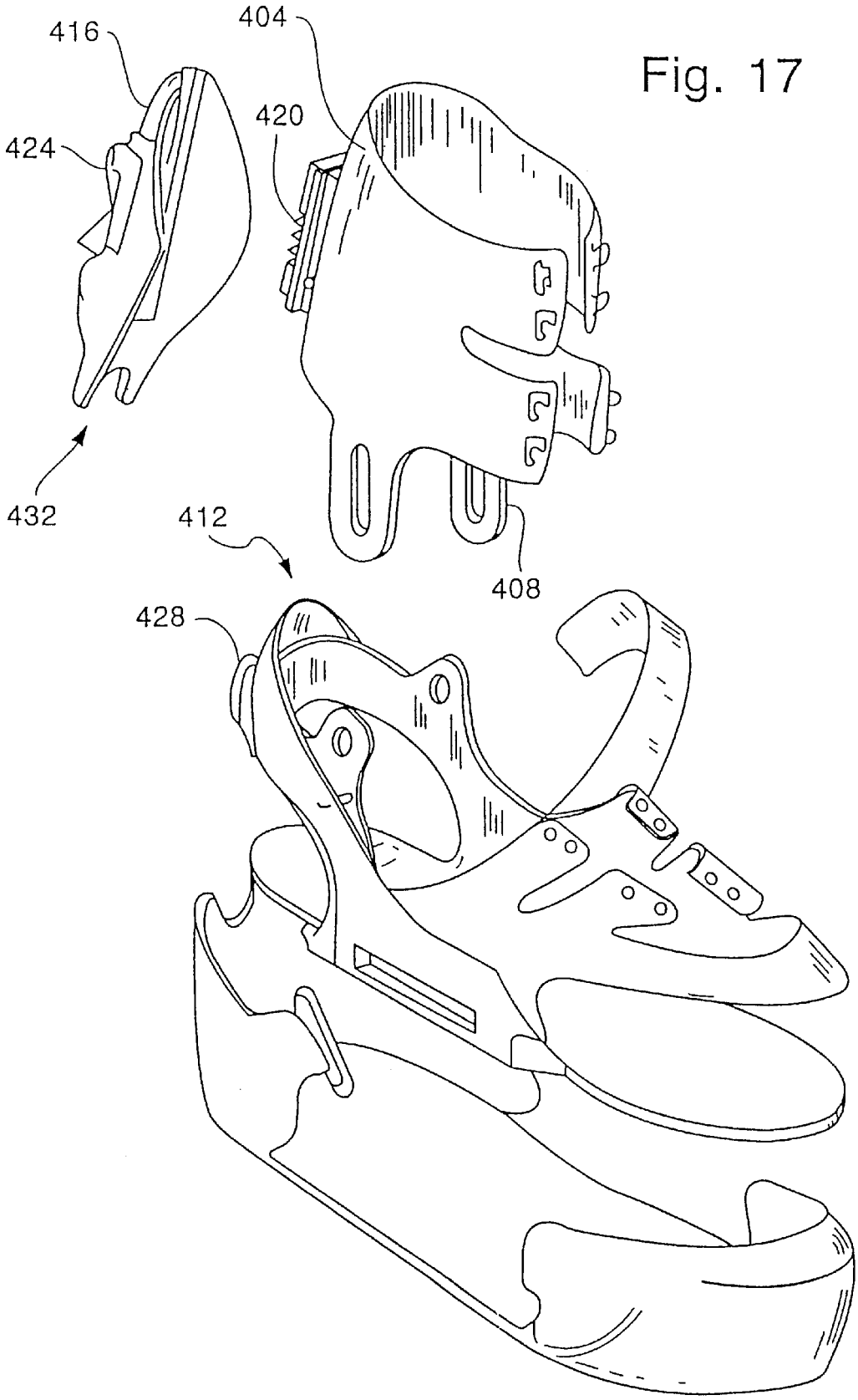
FIG. 17 shows an exploded view of the boot 400.

Yet another aspect of the present invention involves the design and operation of a snowboard boot suitable for use with binding system 20 to provide desired safety and performance characteristics. Referring to FIGS. 15–17, a particular embodiment of a snowboard boot 24 is disclosed (hereinafter labeled boot 400). The boot 400 includes a stiffened upper calf member 404 adjustably attached, via adjustment slots 408, to a boot frame 412, thereby allowing both axial, rotational movement generally corresponding to the angular movement of a snowboarder's ankle (e.g., in a forward-to-backward direction) and adjustment to accommodate a desired calf support height. A substantially rigid high-back element 416 is vertically slidably engageable with the upper calf member 404 so that the high-back element 416 is vertically movable by finger disengagement of adjustment latch 424 (more precisely, teeth 422) from teeth 420. Note that adjustment latch 424 is biased, by spring 426, so that teeth 422 and 420 engage. Further note that the lower portion of the high-back element 416 is releasably engageable with a corresponding nub 428 associated with the rearward portion of a boot frame 412. The lower portion of the high-back element 416 can have a fork-like configuration 432, whereby the fork engages the nub 428 on the boot frame so as to permit side-to-side rotation of the high-back element 416 in a direction substantially perpendicular to the natural forward-rearward angular movement of a rider's ankle. The high-back element 416 is slidably adjustable on the upper calf member 404, and the high-back element is disengageable from the nub 428 on the boot frame 412 so as to facilitate a more natural walking motion by a snowboarder when walking from place to place. Note that the spring 436 urges the high-back element 416 to slide up thereby making easy the disengaging of the high-back element with the nub 428. Further note that the boot 400 embodiment avoids the bulky "high-back" members that enclose and restrict a snowboarder's foot, ankle and (some portion of) calf, utilized on various conventional snowboard bindings. In particular, conventional high-back members are part of the binding itself, adding bulk to the snowboard/binding combination and acting to restrict easy movement of the snowboarder's ankle, thus preventing desired lateral and forward motion between a snowboarder's calf and lower foot.

Figure 24A:
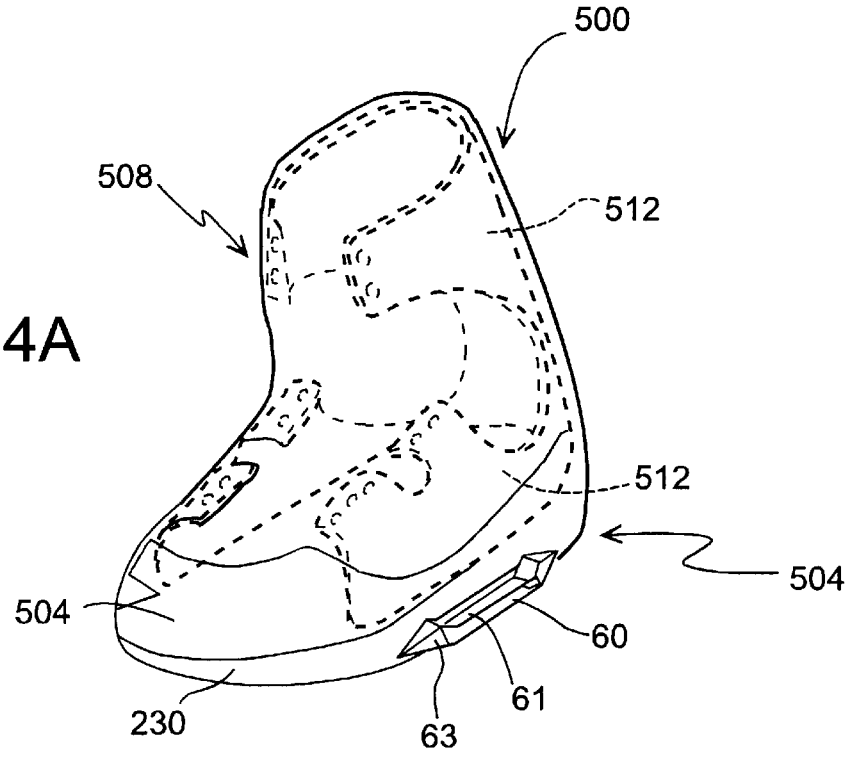
FIG. 24A shows a side view of a hard plastic boot shell with straps affixed thereto.
Figure 24B:
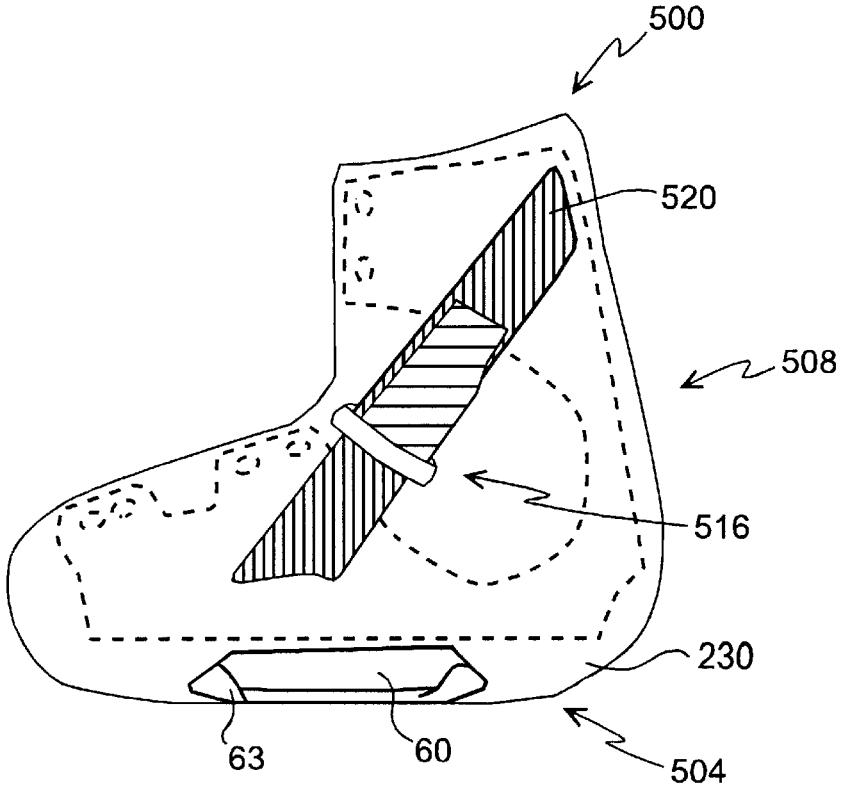
FIG. 24B is a perspective view of a snowboard boot showing a one piece inner plastic boot support with a sole fashioned with side engaging protrusions.

An alternative embodiment of an inner structure of a boot 24 compatible with the present invention is illustrated in FIGS. 24A and 24B, this boot structure embodiment being labeled 500. Accordingly, note that boot inner structure 500 integrates into a single assembly—the "under foot" subassembly 504 (i.e., the boot sole plate 25 242, the boot sole 230, the boot plate 56 and the boot sole tread 254) with the "above foot" subassembly 508 (the functional aspects of the boot frame 412, the high-back support 416 and the upper calf member 404). In one embodiment of the boot inner structure 500, the above foot subassembly 508 includes a one-piece plastic inner boot support 512 substantially following the exterior contours of the above foot portion of the boot. Further, a leather outer covering is attached (e.g., stitched) onto the boot support 512. Subsequently, the plastic and leather above foot subassembly is aligned to overlap the under foot subassembly 504 and is attached (e.g., stitched) onto the inside of the under foot subassembly 504.

Figure 26A:
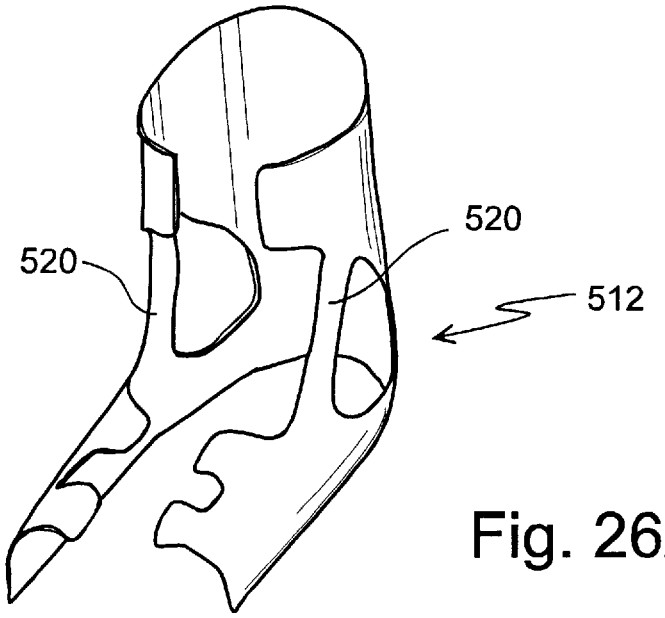
FIG. 26A is a perspective view of another embodiment of a one piece inner plastic boot support with non-adjustable forward lean straps.
Figure 26B:
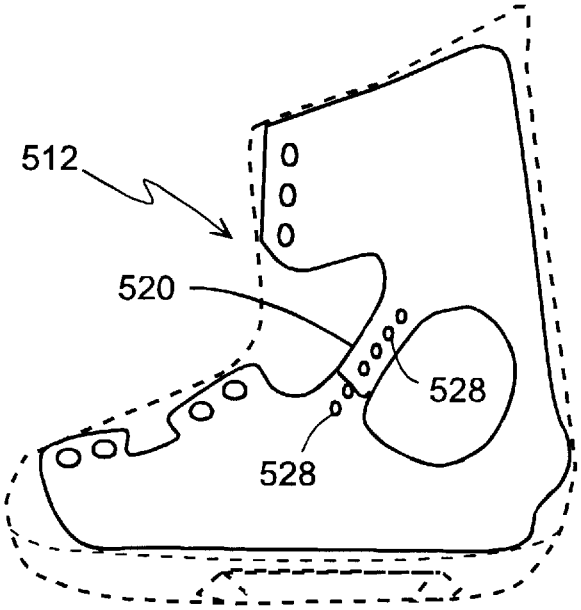
FIG. 26B is a side view of an inner boot support with an adjustable forward lean adjustment.
Figure 26C:
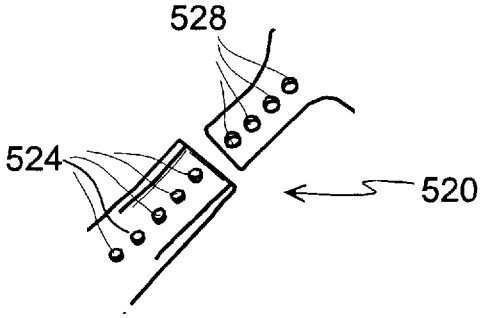
FIG. 26C is a perspective view of how the adjustable strap as shown in 26B can be adjusted through the use of overlapping apertures.

Note that the boot inner structure 500 provides a relatively large ankle cut-out 516 (FIG. 24B) for lateral flex of a snowboarder's ankle bones. However, to restrict movement toward the back of the boot, adjustable straps 520 (preferably on each side of the boot 500) may be attached to the above foot subassembly 508. Note that the straps may be attached on the inside or outside, or both, of the above foot subassembly. Alternatively, a ratchet mechanism may be utilized in place of the adjustable strap 520 as one skilled in the art will understand. This feature facilitates desired forward flex or bending of a snowboarder's leg. As shown in FIGS. 26A–C, the boot can be in a relatively fixed forward lean configuration, or can be adjustable by the snowboarder to accommodate different snow conditions, to facilitate walking, etc.

Figure 25:
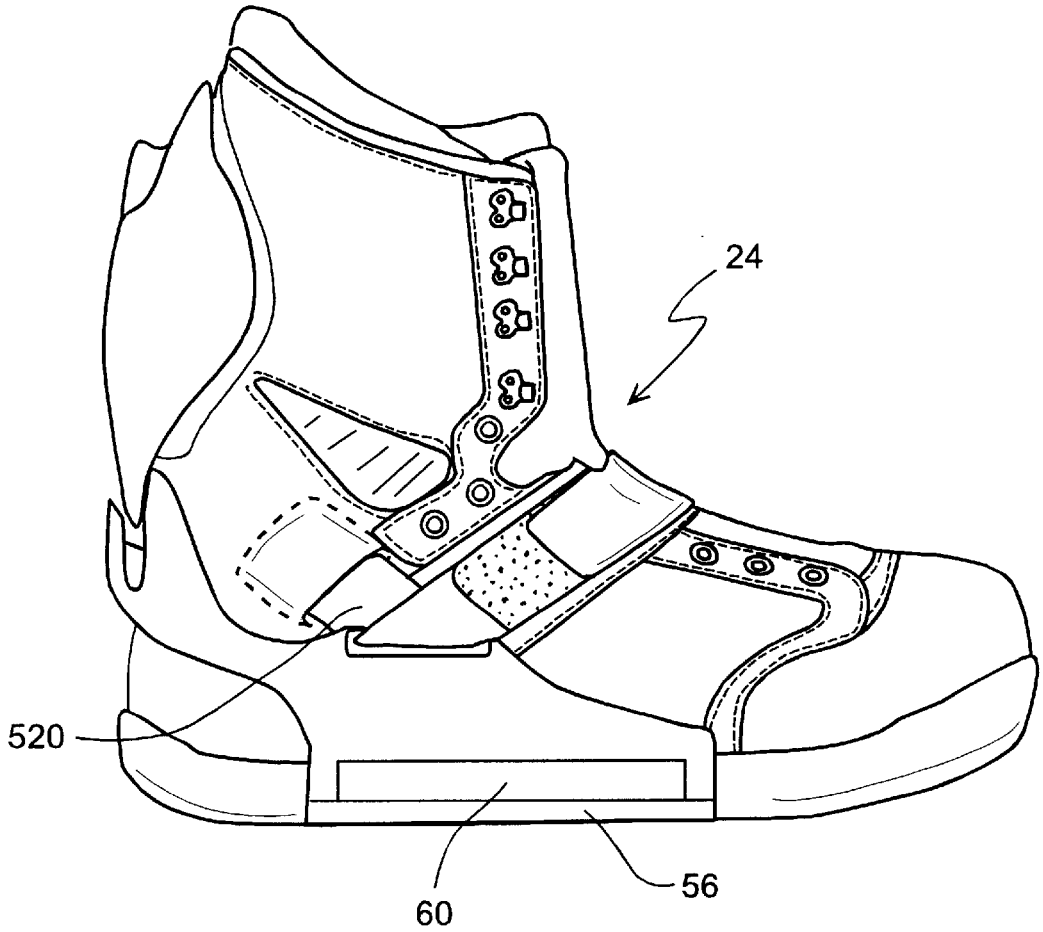
FIG. 25 is a side view of a snowboarder boot showing strap attachments for the boot.

FIG. 25 illustrates the exterior of a boot 24 compatible with the boot structural characteristics of the boot 24 embodiments described above (e.g., FIGS. 17, 18, 21, 22 and 24).

Alternative embodiments of the plastic boot support 512 are shown in FIGS. 26A–26C. In FIG. 26A, the straps 520 are integral with the plastic boot support 512 and are non-adjustable. In one embodiment, the plastic boot support 512 is made out of a "flexy" material which will stiffen the boot but still allow some flex. In FIG. 26B, a similar plastic boot support 512 is shown. However, the integrated straps 520 are now capable of being adjusted via, for example, by corresponding plastic nubs or protrusions and holes 528 that may be adjustably mated with the protrusions 524 as is well known in the art. Note that FIG. 26C illustrates a portion of the strap 520 with the protrusions 524 disengaged from the holes 528. Other adjustability mechanisms can be used which will be understood by those of skill in the art.

Additional alternative embodiments of the combination of the binding system 20 and the boot 24 are also within the scope of the present invention. In particular, mating engaging members and receptacles may be positioned at various positions relative to a snowboarder's boot, including not only either or both sides of a snowboarder's boot, but also either on the toe area and/or heel area of a snowboarder's boot 24. Indeed, in a particular embodiment, the heel portion of a snowboarder's boot may be provided with one or more engaging members 34 (either active or static) that are engageable with one or more active (i.e., movable) heel receptacles 60 of the binding system 20 whereby such an engaging member 34 may be forced into the receptacle 60 by a snowboarder transferring his/her weight from the front of the foot to the heel.

Figure 27A:
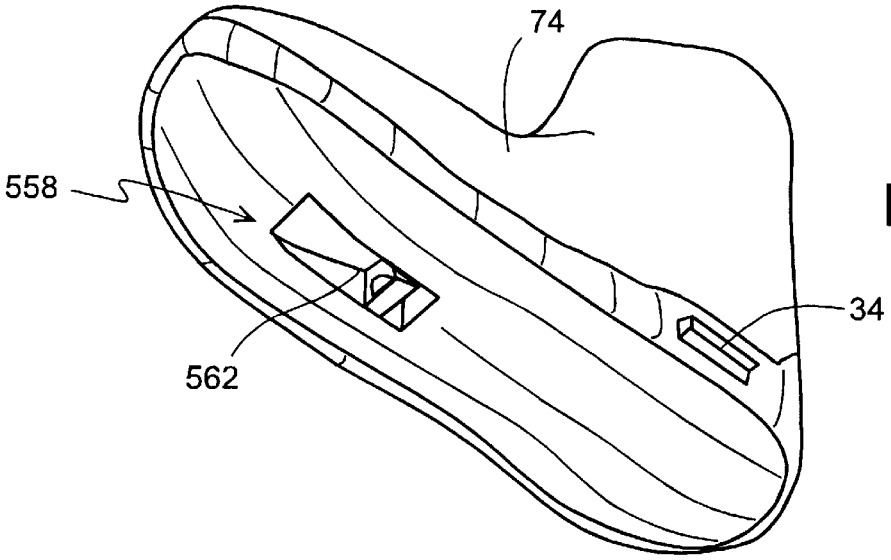
FIG. 27A is a perspective view of a bottom of a snowboard boot having opposing protuberances and/or engaging members, as well as a recess in the bottom sole of a boot with a sole engaging apparatus.
Figure 27B:
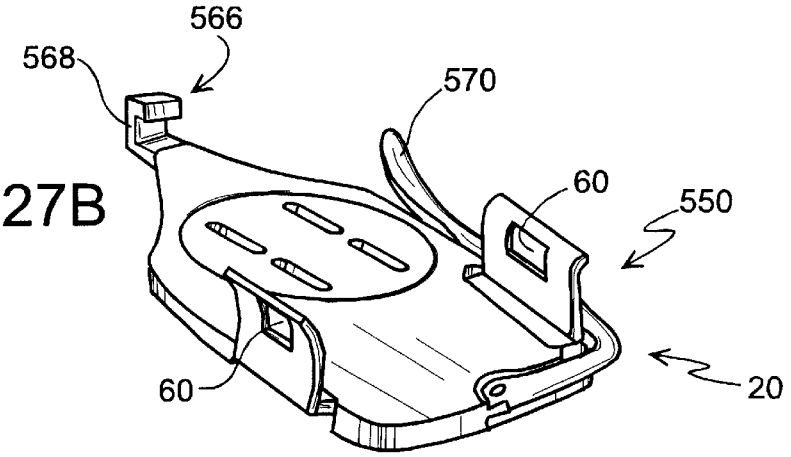
FIG. 27B is a perspective view of a binding system with duo side engaging mechanisms operable by a retraction means, as well as a sole engaging member.
Figure 28:
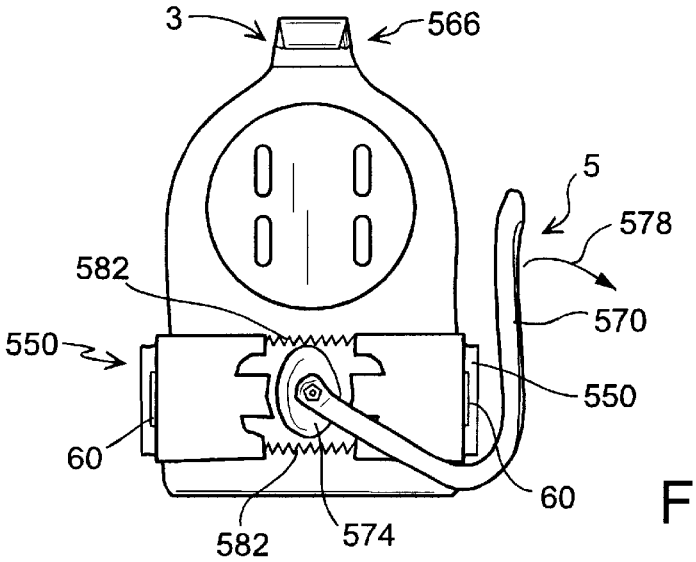
FIG. 28 is a bottom view of the binding system shown in FIG. 27B wherein the retraction means is a lever connected to a cam that reversibly moves engaging members together and apart upon operation of said lever.

FIGS. 27–30 illustrate various of the alternative embodiments where the snowboarder transfers weight to the heel for fully attaching a snowboard boot 24 to a binding system 20. In one embodiment, as illustrated in FIGS. 27A and 27B, a snowboard boot 24 may be provided with static (i.e., non-movable) engaging members 34 on opposite sides of the boot heel. These engaging members 34 are for receipt by receptacle prongs 550 having receptacles 60. In the sole of the snowboarder's boot 24 is a recessed area 558 wherein an engaging recess 562 is provided. This engaging recess 562 interlocks with a sole binding assembly 566 having a hook 568, thereby providing for a three point interlocking binding system. The receptacle prongs 550 are movable by a lever 570 in a manner demonstrated in FIG. 28, which shows a bottom view of the binding system 20 shown in FIG. 27B. Referring to FIG. 28, the lever 570 is operatively connected to a cam 574 such that when the lever is rotated along arrow 578, the cam 574 is also rotated thereby causing the receptacle prongs 550 to move away from each other to an open position, and when the lever 570 is allowed to retract, under the bias of the springs 582, into a closed position, the receptacle prongs 550 are also urged together by the springs 582. In such a manner, a snowboard boot 24 having the design as shown in FIG. 27A can be reversibly fixedly attached to the binding system 20 as shown in FIGS. 27–28.

Figure 29A:
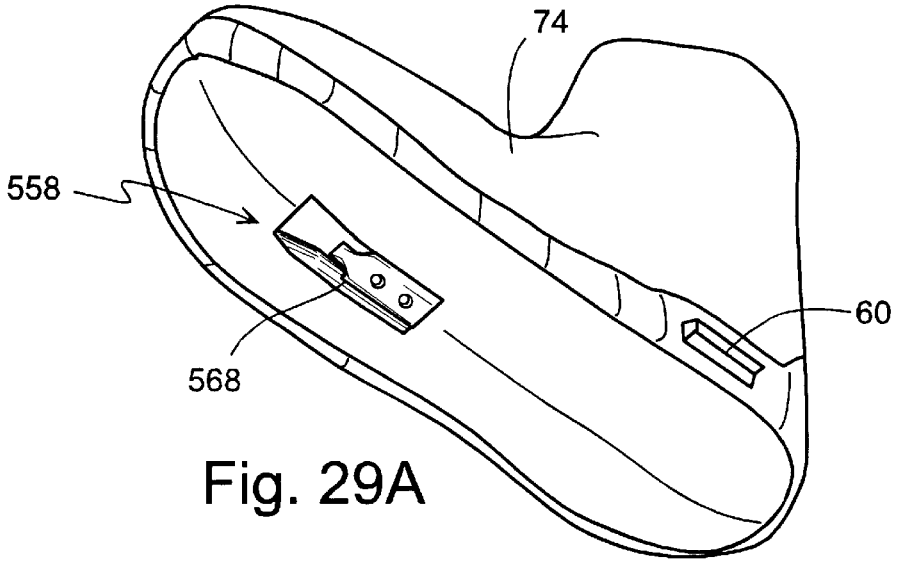
FIG. 29A is an exploded perspective view of the boot shown in FIG. 27A with a binding system of the present invention.
Figure 29B:
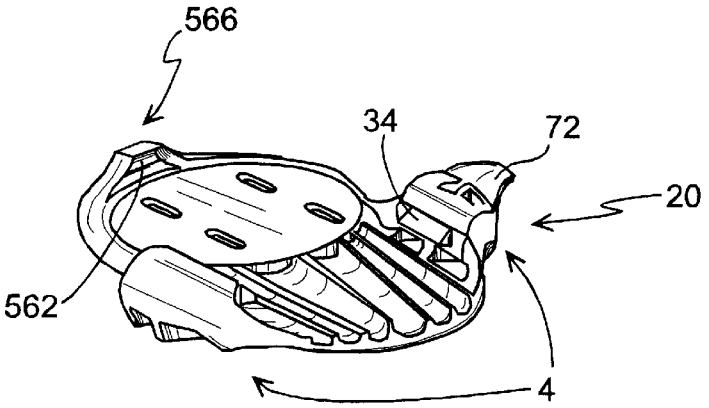
FIG. 29B is a side view showing the sunken hook means used to engage the sole engaging mechanism.
Figure 29C:
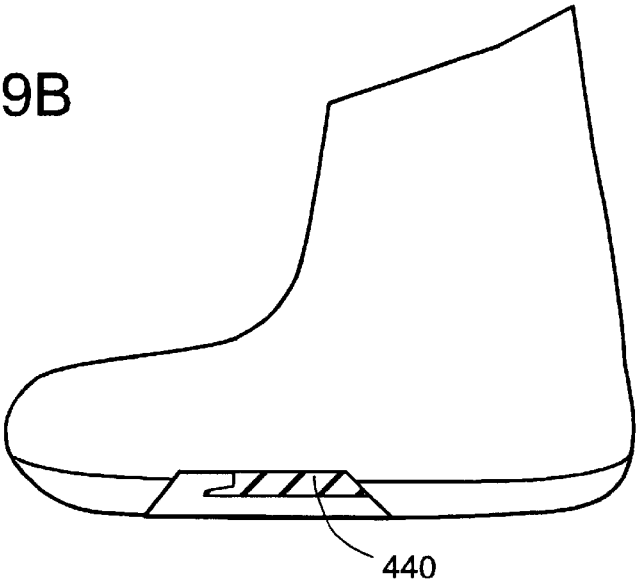

Another embodiment of the binding system 20 and the boot 24 is shown in FIGS. 29A and 29B wherein the engaging members 34 are again part of the binding system 20 and the receptacles 60 are on the boot 24, but these components are displaced toward the heel as in FIGS. 27A–B. Moreover, the hook 568 is now provided in the recessed area of the boot sole 558 while the engaging recess 562 is now provided in the sole binding assembly 566.

Figure 30A:
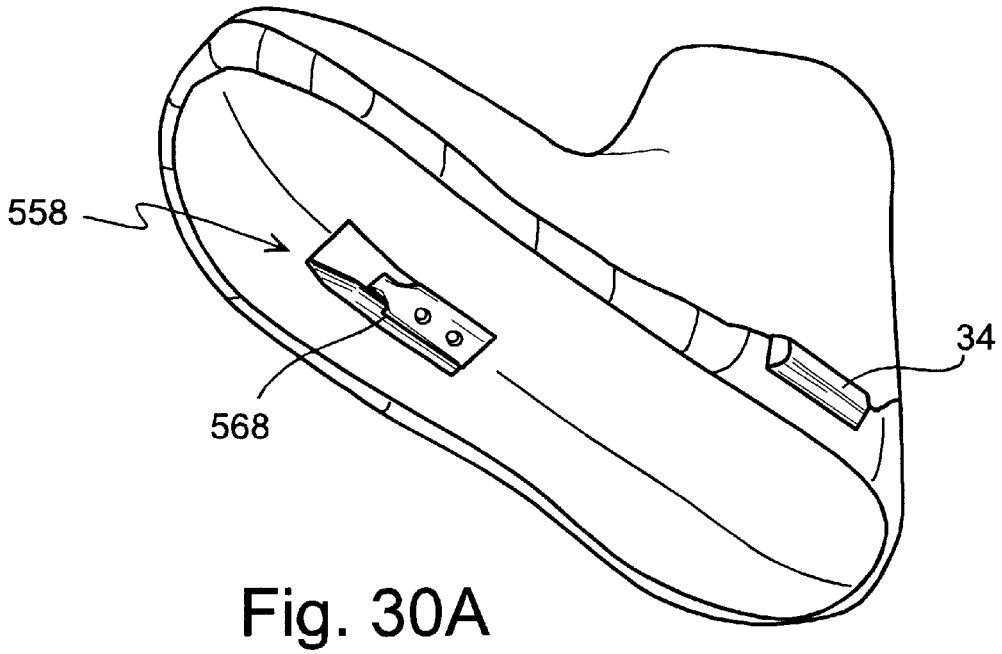
FIG. 30 is an exploded view of a boot and a binding system whereby the binding system has two relatively static engaging members and the boot is provided with active engaging members.
Figure 30B:
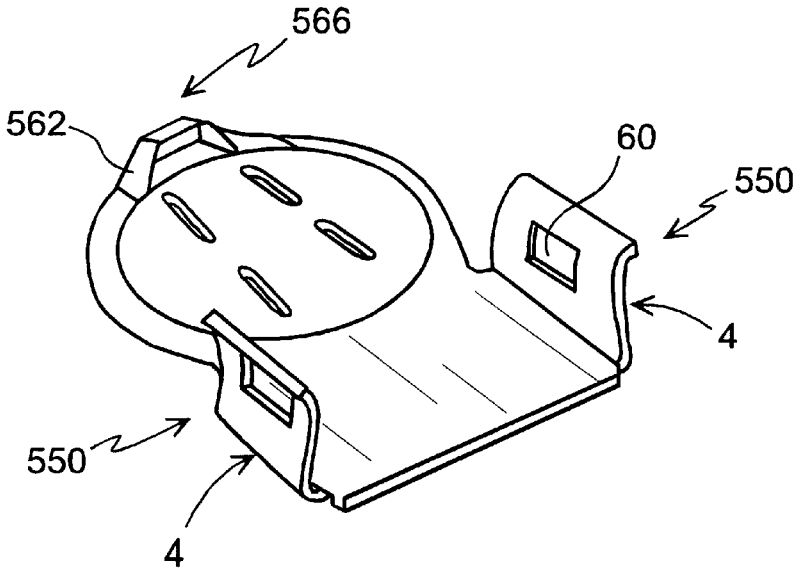

Yet another embodiment is shown in FIG. 30, wherein a snowboard boot 24 includes active engaging members 34 that are reversibly compressible into the boot sole via, for example, a cable within the boot as one skilled in the art will understand. Accordingly, these active engaging members 34 may interact with a passive binding system 20 having receptacle prongs 550 and a sole binding assembly 566 that can operatively engage the hook 568 within the recessed area of the boot sole. Thus, the heel of a snowboarder's boot 24 can be engaged into the passive receptacle prongs 550 when the engaging member 34 is compressed into the boot 24 by a cable or merely by the receptacle prong 550, until the receptacle 60 accepts the engaging member 34.

In another embodiment to the present invention, the combination snowboard binding system 20 and boot 24 may further include a warming means capable of producing sufficient heat to do one of several things: melt snow/ice from around the surface of the binding plate, thereby eliminating interference of snow and ice from binding engagement and provide warmth to the snowboard rider's feet when connected to the snowboard binding system, etc.

Figure 31A:
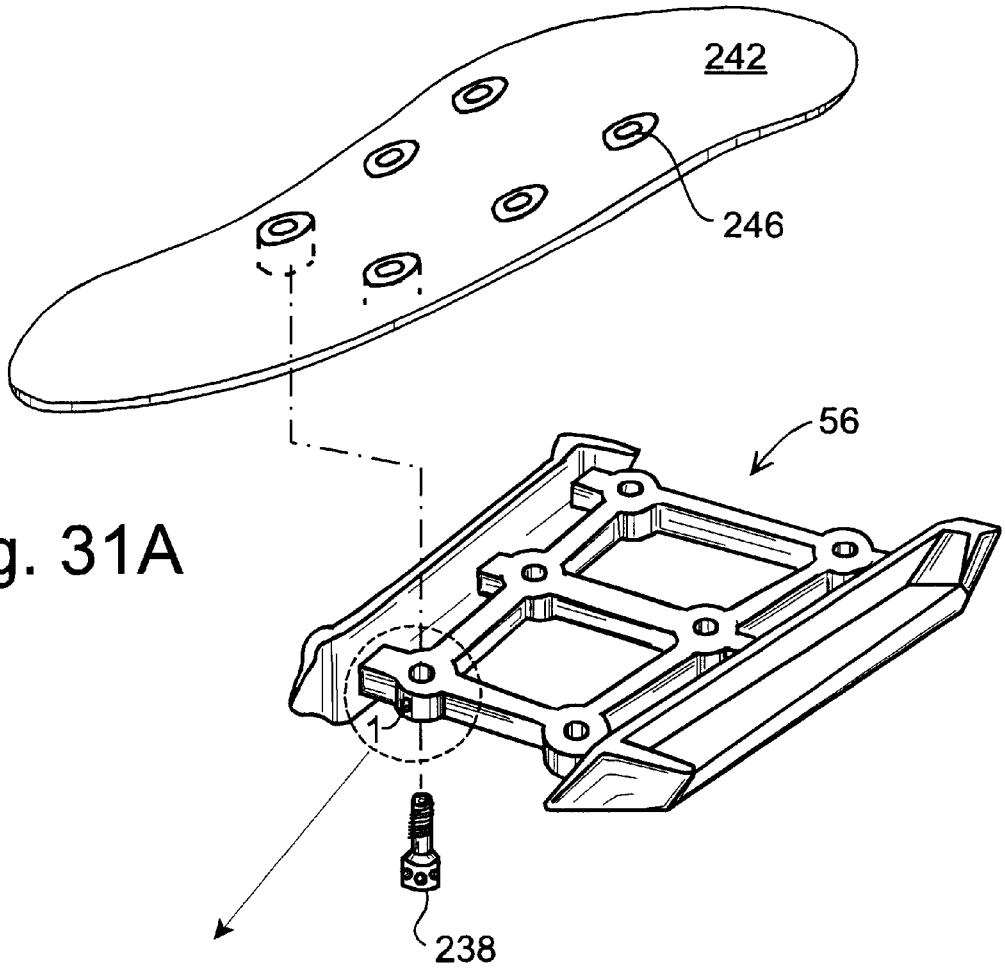
FIG. 31A is an exploded view of a binding plate as it relates to a sole plate 242, illustrating the ability to provide a canting of a snowboarder's boot sole with respect to the surface of a snowboard.
Figure 31B:
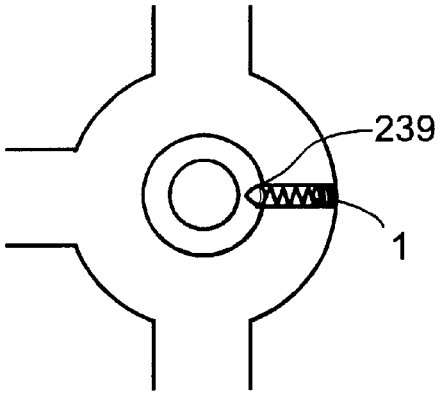
FIG. 31B shows a cutaway version of a threaded aperture in which an indexing ball bearing 239 mechanism is shown to facilitate desired adjustment of a canting operation.

With reference to FIG. 31, one aspect of the present invention involves the adjustability of the relationship between a boot binding plate 56 and a sole plate 242 in order to provide a desired cant of the snowboarder's foot orientation. For example, to facilitate the uplifting of a heel portion of a sole plate 242, a screw 238 can be rotated to urge the heel portion of the sole plate 242 upward in relationship to the binding plate 56. The cant adjustment screw 238 can be provided with spaced divots that interact with a spring loaded ball bearing 239 positioned in the binding plate 56. In such a manner, a snowboarder can visually and audibly adjust the particular cant of the sole plate 242 with respect to the binding plate 56 in that the ball bearing 239 will fit within the divots in the head of the screw 238. Adjustments of the cant of a sole plate 242 can be made utilizing numerous other mechanisms (not shown) including, but not limited to, air bladders, gel packets, foam inserts, etc. Canting of a sole plate 242 facilitates desired orientation of a snowboarder's foot so as to cause a snowboarder's legs to move inward toward each other in situations where such body orientation provides for better balance and stability.

While various embodiments of the present invention have been described in detail, it is apparent that modifications and adaptations of those embodiments will occur to those skilled in the art. However, it is to be expressly understood that such modifications and adaptations are within the scope of the present invention, as set forth in the following claims.

What is claimed is:

1. A snowboard binding system, comprising:

a boot engaging plate attached to the top surface of a snowboard, said boot engaging plate having at least two engaging members engageabIe to opposite sides of a snowboarder's boot such that said boot, once engaged by said engaging members, is secured to the snowboard, said engaging members being movable between an engaging position and a disengaging position in which the engaging members are separated by a greater distance than in the engaging position, whereby vertical pressure by said boot towards said boot engaging plate when the snowboarder's boot is stepped vertically downwardly onto said binding system is sufficient to move said engaging members to said engaging position said engaging members being biased to assume the engaging position upon downward movement of the boot into a properly secured arrangement with said binding system;

a disengaging member operatively associated with at least one of said engaging members to move said at least one of said engaging members from the engaging position to the disengaging position, said disengaging member being capable of manipulation by a snowboarder's hand;

an engagement indicator which indicates to a snowboarder that the boot is secured to said binding system in the properly secured arrangement, an indication of a properly secured arrangement by the engagement indicator being selected from the group consisting of one of the appearance and the disappearance of a colored segment operatively associated with one of said engaging members and a signal relaying one of an audible signal and a visual signal; and one or more positioning contoured members which guide the snowboarder's boot into the properly secured arrangement, said positioning contoured members being configured for directing the snowboarder's boot into the properly secured arrangement as the snowboarder's boot descends downwardly.

2. The snowboard binding system of claim 1, further comprising a locking mechanism operatively associated with said disengaging member adapted to prevent the disengaging member from moving from between the engaging and disengaging positions.

3. The binding as set forth in claim 1, wherein said disengaging member is openable only to disengage a snowboard boot from said binding system and is not required to be manipulated for entry of said snowboard boot into said binding system.

4. The snowboard binding system as set forth in claim 1, further comprising a high back element operatively associated with said binding system.

5. The snowboard binding system as set forth in claim 1, further comprising an element selected from the group of a toe plate element and a heel plate element for altering the position of a snowboarder's boot in relation to the snowboard.

6. The snowboard binding system as set forth in claim 1, wherein said contour members correspond with surfaces an the snowboard boot.

7. The snowboard binding system as set forth in claim 1, wherein said engaging members engage with recesses formed in a snowboarder's boot.

8. The snowboard binding system as set forth in claim 1, further comprising a canting mechanism operatively associated with said boot engaging plate to facilitate various angular orientations of a snowboarder's boot with respect to the surface of the snowboard.

9. A snowboard binding for securing a snowboard boot to a snowboard, the binding having an open position and a closed position, the binding comprising:

a base adapted to receive a snowboard boot;

a first active boot engaging member mounted to the base adapted to engage a first lateral side of a snowboard boot when the binding is in the closed position;

a second active boot engaging member mounted to a base adapted to engage a second lateral side of the snowboard boot when the binding is in the closed position;

a locking assembly including a locking member mechanically coupled to one of said first and second engaging members, said locking member having an unlocked configuration and a locked configuration respectively corresponding to the open and closed positions of the binding;

first and second tensioning members operatively associated respectively with said first and second engaging members, said engaging members being movable between an engaging position and a disengaging position corresponding to closed and open positions respectively of the binding, whereby vertical pressure by said boot towards said base when the snowboarder's boot is stepped vertically downwardly onto said binding is sufficient to move said engaging members to said engaging position, said engaging members being biased to assume the engaging position upon further downward movement of the boot into a properly secured arrangement within said binding;

an engagement indicator which indicates to a snowboarder that the snowboard boot is secured to said binding in the properly secured arrangement, an indication of a properly secured arrangement by said engagement indicator being selected from the group consisting of one of the appearance and the disappearance of a colored segment operatively associated with one of said engaging members and a signal relaying one of an audible signal and a visual signal, and at least one static element operatively associated with said binding to prevent horizontal movement of a snowboarder's boot when in said closed position.

10. The snowboard binding system as set forth in claim 9, further comprising a high back element operatively associated with said binding system.

11. The snowboard binding system as set forth in claim 9, further comprising a element selected from the group of a toe plate element and a heel plate element for altering the position of a snowboarder's boot in relation to the snowboard.

12. The snowboard binding system as set forth in claim 9, wherein said locking member is adjustable to maintain at least one of said engaging members in a retracted position.

13. The snowboard binding system as set forth in claim 9, wherein said engagement indicator comprises the appearance of a colored segment operatively associated with one of said engaging members.

14. The snowboard binding system as set forth in claim 9, wherein said engaging members engage with recesses formed in a snowboarder's boot.

15. The snowboard binding system as set forth in claim 9, further comprising a canting mechanism operatively associated with said base to facilitate various angular orientations of a snowboarder's boot with respect to the surface of the snowboard.

16. The snowboard binding system as set forth in claim 9, further comprising static elements to prevent horizontal movement of a snowboarder's boot when in said closed position.

17. A snowboard binding system, comprising:

a boot engaging plate attached to a top surface of a snowboard, said boot engaging plate having at least two boot engaging members engageable to opposite lateral sides of a snowboarder's boot such that said snowboarder's boot, once engaged by said engaging members, is secured to the snowboard, said engaging members being movable between an engaging position and a disengaging position corresponding to closed and open positions respectively of the binding system, while in the disengaging position the engaging members are separated by a greater distance than in the engaging position, whereby vertical pressure by said boot towards said boot engaging plate when the snowboarder's boot is stepped vertically downwardly onto said binding system is sufficient to move said engaging members to said engaging position, said engaging members being biased to assume the engaging position upon further downward movement of the boot into a properly secured arrangement within said binding system;

a disengaging member operatively associated with at least one of said engaging members to move at least one of said engaging members from the engaging position to the disengaging position, said disengaging member being capable of manipulation by a snowboarder's hand;

an engagement indicator which indicates to a snowboarder that the snowboarder's boot is secured to said binding system in the properly secured arrangement, an indication of the properly secured arrangement by said engagement indicator being selected from the group consisting of one of the appearance and the disappearance of a colored segment operatively associated with one of said engaging members and a signal relaying one of an audible signal and a visual signal; and a locking assembly including a locking member mechanically coupled to one of said at least two engaging members, said locking member having an unlocked configuration and a locked configuration respectively corresponding to the open and closed positions of the binding system.

18. The snowboard binding system as set forth in claim 17, further comprising a high back element operatively associated with said binding system.

19. The snowboard binding system as set forth in claim 17, further comprising an element selected from the group of a toe plate element and a heel plate element for altering the position of a snowboarder's boot in relation to the snowboard.

20. The snowboard binding system as set forth in claim 17, wherein said locking member is adjustable to maintain at least one of said engaging members in a retracted position.

21. The snowboard binding system as set forth in claim 17, further comprising one or more positioning contoured members which guide the snowboarder's boot into the properly secured arrangement, said positioning contoured members being configured for directing the snowboarder's boot to a central focal point as the snowboarder's boot descends downwardly into the properly secured arrangement.

22. The snowboard binding system as set forth in claim 17, wherein said engaging members engage with recesses formed in a snowboarder's boot.

23. The snowboard binding system as set forth in claim 17, further comprising a canting mechanism operatively associated with said boot engaging plate to facilitate various angular orientations of a snowboarder's boot with respect to the surface of the snowboard.

24. The snowboard binding system as set forth in claim 17, further comprising static elements to prevent horizontal movement of a snowboarder's boot when in said engaging position.

* * * * *

UNITED STATES PATENT AND TRADEMARK OFFICE

CERTIFICATE OF CORRECTION

PATENT NO. : 6,113,127
DATED : September 5, 2000
INVENTOR(S) : Karol

It is certified that error appears in the above-identified patent and that said Letters Patent is hereby corrected as shown below:

In Claim 1, column 18, lines 27-28, the phrase "to said engaging position" is deleted.

In Claim 9, column 19, lines 40-41, the phrase "to said engaging position" is deleted.

In Claim 17, column 20, line 32, the phrase "to said engaging position" is deleted.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*